US009982977B2

(12) United States Patent
Menefee, III

(10) Patent No.: US 9,982,977 B2
(45) Date of Patent: May 29, 2018

(54) PAYLOAD DELIVERY SYSTEM WITH FORWARD FOLDING STABILIZER FOR CARTRIDGES

(71) Applicant: James Y. Menefee, III, Macon, GA (US)

(72) Inventor: James Y. Menefee, III, Macon, GA (US)

( * ) Notice: Subject to any disclaimer, the term of this patent is extended or adjusted under 35 U.S.C. 154(b) by 716 days.

(21) Appl. No.: 14/469,116

(22) Filed: Aug. 26, 2014

(65) Prior Publication Data

US 2016/0363423 A1 Dec. 15, 2016

Related U.S. Application Data

(63) Continuation of application No. 13/599,815, filed on Aug. 30, 2012, now abandoned.

(60) Provisional application No. 61/530,116, filed on Sep. 1, 2011.

(51) Int. Cl.
*F42B 7/08* (2006.01)
*F42B 12/76* (2006.01)

(52) U.S. Cl.
CPC ..... *F42B 7/08* (2013.01); *F42B 12/76* (2013.01)

(58) Field of Classification Search
CPC ..... F42B 7/02; F42B 7/04; F42B 7/06; F42B 7/08
USPC ..... 102/449, 450, 451, 453, 457, 461
See application file for complete search history.

(56) References Cited

U.S. PATENT DOCUMENTS

| | | | | |
|---|---|---|---|---|
| 1,297,216 A | | 3/1919 | Matteus | |
| 2,002,036 A | | 5/1935 | McGavock | |
| 2,125,224 A | | 7/1938 | Edwards | |
| 2,953,990 A | * | 9/1960 | Miller | F42B 7/06 102/449 |
| 3,074,344 A | | 1/1963 | Pierre | |
| 3,270,669 A | | 9/1966 | Atkins et al. | |
| 3,299,813 A | * | 1/1967 | Rickey | F42B 7/08 102/451 |
| 3,313,235 A | | 4/1967 | Middleton, Jr. | |
| 4,295,426 A | | 10/1981 | Genco et al. | |
| 4,733,613 A | | 3/1988 | Bilsbury et al. | |

(Continued)

FOREIGN PATENT DOCUMENTS

| | | |
|---|---|---|
| FR | 1548296 A | 12/1958 |
| FR | 1180220 A | 6/1959 |

(Continued)

OTHER PUBLICATIONS

International Search Report and Written Opinion for PCT/US2012/053060 dated Nov. 23, 2012.

(Continued)

*Primary Examiner* — James S Bergin
(74) *Attorney, Agent, or Firm* — Eversheds Sutherland (US) LLP

(57) ABSTRACT

This disclosure provides for payload delivery systems and cartridges and methods that incorporate the payload delivery systems. The payload delivery system can comprise a stabilizer having a longitudinally cut side wall defining a series of vanes that are folded forward in the pre-launched configuration. Cartridges that include the payload delivery system are disclosed, which can be used to deliver payloads such as solid projectiles, shot of all sizes, powders, gels, liquids, and other payloads to exploit their specific function.

20 Claims, 11 Drawing Sheets

(56) References Cited

U.S. PATENT DOCUMENTS

| | | | | |
|---|---|---|---|---|
| 4,773,329 | A | 9/1988 | Bilsbury | |
| 5,874,689 | A | 2/1999 | Alkhatib et al. | |
| 5,979,330 | A | 11/1999 | Cornell | |
| 6,260,484 | B1 | 7/2001 | Billings | |
| 6,367,388 | B1 | 4/2002 | Billings | |
| 7,243,603 | B2 | 7/2007 | Sheaffer | |
| 7,415,929 | B1 * | 8/2008 | Faughn | F42B 7/08 102/448 |
| 7,814,820 | B2 | 10/2010 | Menefee | |
| 8,418,620 | B2 | 4/2013 | Frank | |
| 8,555,785 | B2 | 10/2013 | Cross | |
| 9,182,202 | B2 * | 11/2015 | Menefee, III | F42B 7/08 |
| 9,739,582 | B2 | 8/2017 | Billings | |
| 2005/0039627 | A1 * | 2/2005 | Zanoletti | F42B 7/08 102/449 |
| 2011/0017090 | A1 | 1/2011 | Menefee | |
| 2013/0055916 | A1 * | 3/2013 | Menefee, III | F42B 7/08 102/334 |

FOREIGN PATENT DOCUMENTS

| | | | |
|---|---|---|---|
| FR | 1437868 | A | 5/1966 |
| SU | 1607552 | A1 * | 4/1992 |

OTHER PUBLICATIONS

International Search Report and Written Opinion for PCT/US2012/053063 dated Nov. 26, 2012.

* cited by examiner

PAYLOAD DELIVERY SYSTEM WITH FORWARD FOLDING STABILIZER FOR CARTRIDGES

CROSS REFERENCE TO RELATED APPLICATIONS

This application is a continuation of U.S. patent application Ser. No. 13/599,815, filed Aug. 30, 2012, which claims the benefit of U.S. Provisional Application No. 61/530,116, filed Sep. 1, 2011, the disclosures of which are incorporated herein by reference in their entireties.

TECHNICAL FIELD OF THE INVENTION

This disclosure relates to cartridges for launching a payload and the cartridge components themselves, including cartridges and components for launching a payload comprising solid projectiles, liquid- or gel-containing projectiles, or powders.

BACKGROUND

Cartridge systems constitute extremely practical constructions and methods for deploying almost any payload or projectile downrange. Typical cartridge systems incorporate the desired payload, a propellant, and some priming composition all within a self-contained unit. While ammunition cartridges are prototypical of cartridge devices, cartridge systems have been used to launch chemical, pyrotechnic, marker, tracer, signaling, non-lethal, explosive, smoke, and other payloads to exploit their specific function. These more complex payloads often require additional complex and expensive components beyond the nominal propellant, projectile, and primer for their effective use in cartridges.

Shotshell cartridges are also complex cartridge systems because shotshells require intricate components beyond those necessary in rifle or pistol rounds. Many of the principles of payload delivery systems developed in shotshell cartridges are applicable to launching chemical, pyrotechnic, signaling, non-lethal, and other complex payloads in their respective cartridges. For example, a shotshell "wad" is the general term applied to the collection of components in a shotshell other than the projectile(s), the propellant, and the primer, which is used for effective delivery of the projectiles. Shotshell wads may be designed for various functions such as providing a seal against expanding propellant gases, containing and stabilizing the projectile(s) for a desired distance downrange, and/or cushioning and barrel protection. Components having similar functions are often required to launch chemical, pyrotechnic, non-lethal, and other complex payloads in a cartridge. In all these cases, the expense and complexity of construction, tooling, and manufacture of these components and the cartridges themselves can be challenging.

Therefore, there exists a need for new cartridge components and structures for the more complex cartridge systems—that is, beyond the projectile, propellant, and primer—that do not require new specialty tooling with its associated high capital costs. There is also a need for cartridge components and cartridges that can be readily adapted for delivering virtually any complex and difficult-to-handle payload downrange, such as powders, liquids, and gels, as well as solids. Such components would be versatile enough to be used in shotshells, but also for launching chemical, pyrotechnic, non-lethal, non-lethal, explosive, and other similarly complex payloads. Desirably, these components would generally avoid the complicated features that can prohibitively increase costs.

SUMMARY OF THE INVENTION

The present disclosure relates to cartridges for delivering payloads, the payload delivering component of the cartridges, and the associated methods of making and using the components and cartridges. Typically, this disclosure uses shotshells as exemplary "complex" cartridge systems and the disclosed components may be discussed in terms of their shotshell applications or aspects. However, the principles of payload delivery systems described herein are applicable to launching chemical, pyrotechnic, signaling, non-lethal, and other complex payloads in their respective cartridges. Indeed, it is to be understood that this disclosure and the appended claims are not limited to shotshells, because the disclosed structures, components, and methods have a wide utility and are adaptable to the delivery of any number of payload types downrange.

One aspect of this disclosure relates to a payload delivery system that includes, as its fundamental element, at least one cup-shaped stabilizer having an open fore end, a closed aft end, and a side wall comprising a plurality of forward folding vanes defined by a plurality of cuts in the side wall. Thus, when the plurality of vanes are forward folded they impart the cup shape to the stabilizer. In various embodiments, the cup-shaped stabilizer can be used for its stabilizing function as a "stabilizing component", or simply "stabilizer", when it is attached to another component in the cartridge. For example, the cup-shaped stabilizer can be or can comprise a stabilizing component which assists in stabilizing the payload during flight to any extent desired. In this aspect, the cup-shaped stabilizer can be attached to another component such as a payload or projectile container or "cup" or attached directly to at least a portion of the payload itself, for example a single projectile, and thereby function as a means to impart high stability and drag to that other component, payload, or projectile. In other various embodiments, the cup-shaped stabilizer itself can be used as a means to embrace the payload, and therefore serve as a high-drag component having a sabot effect, until a point in time or distance after launching at which the cup-shaped stabilizer separates from the payload and delivers it in free flight. By way of example, in this configuration of containing the payload, the cup-shaped stabilizer can assist in launching powders, gels, liquids, capsules containing powders, gels, or liquids, other solids, even other payloads such as solid projectiles, to exploit their specific function.

In its various aspects and embodiments, the stabilizer of this disclosure may be described by terms such as cup-shaped stabilizer, forward folding stabilizer, forward folded stabilizer, stabilizer cup, stabilizer with cut side wall, or simply, stabilizer, and similar terms. These terms are used interchangeably to reflect the same structure, that is, a cartridge component that is cup-shaped in its pre-launched and forward folded condition, having an open fore end, a closed aft end, and a side wall comprising a plurality of vanes that are defined by a plurality of cuts in the side wall. Thus, the vanes result because some or all of the plurality of cuts in the side wall extend to the edge of the cup-shaped "stabilizer" that is defined by its open fore end. Typically, though not necessarily, the cuts in the side wall are longitudinal cuts, substantially longitudinal (for example, not varying more than 30 degrees from longitudinal), and typically, though not necessarily, parallel cuts. The vanes defined by the cuts in the stabilizer side wall also may be termed vanes ribbons, strips, fins, wings, flaps, segments, and the like, and such terms are used interchangeably. When used in conjunction with a separate component that functions as a payload cup, this cup-shaped component is coaxially aligned with the payload cup and is generally attached to the payload cup in its pre-launched condition.

These alternative terms for the cup-shaped component may be used regardless of any momentary configuration the component may be in. For example, terms such as forward folding stabilizer, forward folded stabilizer, and the like may be used to describe this component even after it has been launched from a cartridge, and the vanes are not forward folded, even if the vanes have unfolded and inverted such that the open end of the stabilizer now points uprange or in the aft direction.

The cup-shaped stabilizer defines a cavity that can contain either the payload itself, or the cavity can contain a payload cup or container in which the payload cup or container contains the payload. For example, when the cup-shaped stabilizer is attached to the payload cup, it may be referred to as a stabilizing component or stabilizer, because it functions to impart stability and different degrees of drag to the payload cup during flight, for a desired ballistic performance. The combined and attached cup-shaped stabilizer and payload cup, which may be referred to as a "stabilized payload cup", can provide for early or late release of the payload as desired, because stability is achieved by the function of the cup-shaped stabilizer. Additional structures and functions can be incorporated into a stabilized payload cup, such as a means to puncture or rupture a capsule that houses a gel or liquid payload contained within the stabilized payload cup.

In one aspect, the cut side wall of the cup-shaped stabilizer can be cut in a fashion such that the vanes cover substantially all the side wall area of the payload cup in the forward folded or "pre-launched" configuration, because each vane is flush against a neighboring vane. Alternatively, the cut side wall of the stabilizer can be structured such that at least some of the vanes are missing, shaped in different ways, have gaps between the vanes such that each vane is not flush against a neighboring vane, and similarly diverse configurations. Still alternatively, the cut side wall of the stabilizer can be structured such that at least some of the vanes overlap each other, which can aid in the sabot function. The common structural theme of the stabilizer is that it comprises vanes that are forward folding in their pre-launched configuration, and subsequently unfold after launching to provide a stabilizing and drag function.

When constructed of suitable materials, the cup-shaped stabilizer of this disclosure can contain the payload in its own cavity. In this aspect, the cup-shaped stabilizer functions as its own type of payload container or payload cup, rather than functioning as a stabilizer, to achieve the desired performance with certain payloads, such as powders. For example, a cup-shaped stabilizer can impart a sabot effect on a projectile that it contains and be used to fire a projectile that is sub-bore diameter and to hold that projectile in a more precise position throughout launching. Also by way of example, using the cup-shaped stabilizer to contain and launch the payload itself can be useful for imposing a sudden charge of powder or liquid into a confined space, such as might be required in chemical, biological, or other encounters. When used in this fashion, the typical embodiments do not have gaps between the individual vanes such that each vane is either flush against a neighboring vane or overlaps a neighboring vane. In this manner, the barrel protection and sabot function are bolstered.

Typically, the stabilized payload cup or the cup-shaped stabilizer itself can be used in conjunction with an obturating component to provide a seal against expanding propellant gases. This disclosure provides for use of virtually any obturating component, including pre-formed gas seals of any type or an obturating medium. When using a pre-formed gas seal, the pre-formed gas seal can be loaded into the cartridge as a separate component, or it can be attached in any manner to the stabilized payload cup or the cup-shaped stabilizer itself and used as the combination in a cartridge.

Accordingly, the present disclosure generally relates to cartridges for delivering payloads, the payload delivering components of cartridges, and the associated methods of making and using the components and cartridges. Among other things, this disclosure provides for a payload delivery system comprising, in its pre-launched configuration:

a) a payload cup having an open fore end, a closed aft end, and a cylindrical side wall defining a cavity; and b) a stabilizer coaxially aligned with the payload cup, having an open fore end, a closed aft end, and a side wall comprising a plurality of forward folding vanes defined by a plurality of cuts in the side wall;

wherein the payload cup is nested within the stabilizer, and the payload cup aft end is adjacent and attached to the stabilizer aft end.

In this aspect, the cup-shaped stabilizer is attached in some manner to the payload cup to ensure stability and provide drag for a clean separation of the payload cup from the payload. The payload cup aft end and the stabilizer aft end can be connected or attached by any means, without limitation, and attachment does not require a connector component. For example, when made of the appropriate materials, the payload cup and the stabilizer can be attached by a melting process, by a punching method, by a sonic weld process, and the like. In various embodiments, the payload cup and the stabilizer can be attached by a connector component. For example, the connector can be selected from a rivet, a screw, a staple, a pin, a bolt, a brad, an anchor, an adhesive, a tack, or a nail, or in certain embodiments, multiple connectors, or any combination of these connectors.

The stabilizer also is not limited as to the material from which it is fabricated. For example, in some aspects, the stabilizer can be made of any type of paper, plastic, polymer-coated paper, fabric, and more, depending on the particular payload and/or cartridge and the properties desired for the stabilizer with respect to its function.

Similarly, the payload cup also is not limited to a particular material, and the material is selected for its properties of thickness, strength, ease of fabrication, and so forth. For example, in some aspects, the payload cup can be made of any type of paper, polymer or plastic, polymer-coated paper, and the like, depending on the particular payload and cartridge and the intended launching parameters such as velocity that are needed. In some embodiments, the closed aft end of the payload cup can be crimped closed, which simplifies the construction and lowers the cost of the payload delivery system. This payload delivery system can further comprise a pre-formed gas seal attached thereto or used a pre-formed gas seal as a separate element, or this payload delivery system can employ so-called "wadless" technology which does not require a pre-formed gas seal of any type.

In a further aspect, this disclosure provides for a cartridge comprising a payload delivery system as disclosed herein, wherein the cartridge is an ammunition cartridge, a flare cartridge, a smoke flare cartridge, a signaling device cartridge, a chemical cartridge, a distraction device cartridge, a pyrotechnic launching device cartridge, a marking cartridge, a grenade launcher cartridge, an incendiary cartridge, an explosive cartridge, a tracer cartridge, an armor-piercing cartridge, or a non-lethal cartridge.

In a further aspect, this disclosure provides for a payload delivery system that comprises, in its pre-launched configuration:

a) a stabilizer having an open fore end, a closed aft end, and a side wall defining a cavity, the side wall comprising a plurality of forward folding vanes defined by a plurality of longitudinal cuts in the side wall;
b) an obturating component adjacent the stabilizer aft end; and
c) at least one payload contained within the cavity of the stabilizer.

By way of example, the obturating component can comprise a pre-formed gas seal coaxially aligned with the payload cup or an obturating medium. In this aspect, the cup-shaped stabilizer typically is used as a means to contain, support, or contain the payload until a point in time or distance after launching the stabilizer separates from the payload and delivers it in free flight. In this configuration of containing the payload itself, the stabilizer can assist in launching powders, gels, liquids, capsules containing powders, gels, or liquids, other solids, even other payloads such as solid projectiles, to exploit their specific function. Therefore, this construction can be adjusted across a range of applications for launching a number of payloads.

Moreover, this disclosure also provides for a cartridge comprising, in its pre-launched configuration, a cup-shaped stabilizer having an open fore end, a closed aft end, and a side wall comprising a plurality of vanes defined by a plurality of longitudinal cuts in the side wall.

There is further provided a payload delivery system comprising, in its pre-launched configuration, a cup-shaped stabilizer having an open fore end, a closed aft end, and a cut side wall defining a cavity. Accordingly, this disclosure further provides a method of loading a cartridge comprising charging a cartridge case with a cup-shaped stabilizer having an open fore end, a closed aft end, and a side wall comprising a plurality of vanes defined by a plurality of cuts in the side wall. In accordance with another aspect, the plurality of cuts in the side wall of the stabilizer can comprise, or alternatively can be, longitudinal cuts, substantially longitudinal cuts, or cuts that are not longitudinal. This novel aspect can include embodiments in wherein the cut side wall is in contact with the inner wall of the cartridge case. Various embodiments of this method can further comprise charging the cartridge case with an obturating component adjacent the cup-shaped stabilizer aft end.

While this disclosure is applicable to the construction of shotshells, flare cartridges, chemical cartridges, signal cartridges, non-lethal cartridges and the like, it is not necessary to fire these cartridges from a firearm or a device that includes a muzzle. To the contrary, certain cartridges such as flare or chemical cartridges that include the disclosed components can further incorporate a system for self-firing or self-activation of the cartridge without a separate firing device like a flare gun. Optionally, such cartridges with the firing component or trigger device built in can be protected from accidental firing by a pin or other type of firing safety.

Another aspect of this disclosure is provided in the operation of the payload delivery system upon being launched from the cartridge, particularly the function of the cup-shaped stabilizer. The stabilizer is a cup-shaped component having a cut side wall, which has its open end forward-facing, whether used in combination with a separate payload cup to which it is attached or whether used in the absence of a separate payload cup. When attached to a separate payload cup, the cup-shaped stabilizer is generally coaxially aligned with the payload cup, and the payload cup is nested within the stabilizer to which it is attached. In this configuration, the open ends of both the stabilizer and the payload cup are directed forward, in a downrange fashion. Upon launching, the entire payload delivery system comprising the payload cup, cup-shaped stabilizer, and the selected payload, is discharged from the cartridge along with the selected payload. After a certain distance in flight, the stabilizer opens and inverts, much like an umbrella will invert from a gust of wind, and the trailing material imparts both high drag and high stability to the cartridge payload delivery system in this manner.

This disclosure further provides for a cartridge comprising a payload delivery system as described herein. If desired, the cartridge can comprise a conventional pre-formed gas seal in combination with the disclosed payload delivery system, or the cartridge can utilize the disclosed payload delivery system with an obturating medium that is not pre-formed into a gas seal. This latter, wadless technology provides an extremely versatile system to launch a range of projectiles downrange. In this aspect, for example, a cartridge according to this disclosure can comprise:

a) a cartridge case having a fore end and an aft end and, comprising a primer situated at the aft end;
b) a propellant adjacent the primer;
c) an obturating medium adjacent the propellant;
d) a payload delivery system adjacent the obturating medium comprising a cup-shaped stabilizer and optionally further comprising a payload cup, and
e) a payload at least partially contained within the cavity of the cup-shaped stabilizer or the payload cup;

wherein the cartridge does not contain a pre-shaped gas seal.

In a further aspect to the above-disclosed cartridge, the obturating medium can be used in combination with a pre-formed gas seal or alternatively, can be replaced by a pre-formed gas seal if desired. By way of example, the cartridge payload delivery system can be used with an obturating medium such as a granular polyethylene, polypropylene, or a combination thereof.

The fundamental aspects of the payload delivery system, that is, the payload cup, the cup-shaped stabilizer, and their embodiments, configurations, and other aspects disclosed herein, are applicable to launching payloads in any manner known. Thus, while the payload delivery system and payload can be discharged using cartridges, the system and payload also can be launched using compressed gases such as in a $CO_2$ or air gun, or in a pressure device that uses a liquid as a reactive mass.

When taken in conjunction with the accompanying drawings, detailed description, and the appended claims, the various features of this disclosure become apparent. Supporting aspects of this disclosure are found, for example, in the following publications and patents, each of which is incorporated herein by reference in its entirety: Thomas J. Griffin, editor, *Shotshell Reloading Handbook,* 5$^{th}$ ed., Lyman Publications, Lyman Products Corporation, Middletown, Conn., c. 2007; Don Zutz, *Hodgdon Powder Company Shotshell Data Manual,* 1$^{st}$ ed., Hodgdon Power Company, Shawnee Mission, Kans., c. 1996; Bob Brister, *Shotgunning: The Art and the Science*, Winchester Press, New Win Publishing, Inc., Clinton, N.J., c. 1976; and U.S. Patent Application Publication Number 2011/0017090. Even though each of these incorporated references concern shotshells and their components, shotshells are used herein as exemplary cartridge systems and the disclosed components, methods, and principles are applicable to launching any type of payload in a cartridge system. The disclosure and the appended claims are not limited to shotshells, because the disclosed structures, components, and methods have a wide utility and are adaptable to any number of payload delivery systems.

BRIEF DESCRIPTION OF THE DRAWINGS

Various aspects and embodiments of this disclosure are illustrated in the drawings in which like reference characters designate the same or similar parts throughout the figures.

FIG. 2A illustrates a payload delivery system with a forward folding stabilizer having identical vanes, in which no vanes or fins have been removed, perforated, or shortened. FIG. 2B illustrates a payload delivery system with a forward folding stabilizer in which alternating vanes have been removed. FIG. 2C illustrates a payload delivery system with a forward folding stabilizer in which alternating vanes have been removed and every other remaining vane has been shortened.

FIG. 3A illustrates an alternative forward folded stabilizer in which the stabilizer side wall comprises a plurality of vanes defined by a plurality of parallel, but non-longitudinal, cuts in the side wall. FIG. 3B illustrates an alternative forward folded stabilizer in which the stabilizer side wall comprises a plurality of vanes defined by a two types of non-longitudinal cuts in the side wall in which alternating cuts are parallel.

FIG. 4A provides a perspective view of a forward folding component that includes longitudinal slits through the stabilizer side wall. FIG. 4B provides a perspective view of a forward folding component that includes perforations through the stabilizer side wall. FIG. 4C provides a perspective view of a forward folding component that includes cut-outs through the stabilizer side wall with different vane lengths.

FIG. 8A illustrates an end-on view of a representative embodiment of a payload delivery system prior to folding the stabilizer and before loading the system into a cartridge, showing the payload cup, the stabilizer prior to folding, and the connector, in which the aft end of the payload cup is crimped closed using a 6-point star crimp. In the illustrated embodiment, the connector is a blind rivet that holds the stabilizer to the crimped end of the payload cup.

FIG. 8B illustrates a perspective view of a representative embodiment of a payload delivery system corresponding to that shown in FIG. 8A, prior to folding the stabilizer and before loading the system into a cartridge, showing the payload cup and the stabilizer prior to folding. In this view, the connector is not seen.

FIG. 8C illustrates a sectional view of a representative embodiment of a payload delivery system corresponding to that shown in FIG. 8A, prior to folding the stabilizer and before loading the system into a cartridge, showing the payload cup, the stabilizer prior to folding, and the connector, in which the aft end of the payload cup is crimped closed. In the illustrated embodiment, the connector is a blind rivet that holds the stabilizer to the crimped end of the payload cup.

FIG. 8D illustrates a sectional view of a representative embodiment of a payload delivery system also corresponding to that shown in FIG. 8A, prior to folding the stabilizer and before loading the system into a cartridge, showing the payload cup, the stabilizer prior to folding, and the connector, in which the aft end of the payload cup is crimped closed. The embodiment shown illustrates a unitary preformed gas seal that include a gas seal portion and a connector portion comprising a blind rivet that is integral to the gas seal portion.

FIG. 9A provides an end-on view of the representative embodiments of a payload delivery system in its pre-launched configurations of FIGS. 9C and 9D, viewed perpendicular to the 500-500' line, and showing the payload cup, the forward folded stabilizer, and the connector, in which the aft end of the payload cup is crimped closed using a 6-point star crimp. In the illustrated embodiment, the connector is a "tri-grip" triangular blind rivet that accommodates the 6-point star crimp to hold the forward folded stabilizer to the crimped end of the payload cup very tightly.

FIG. 9B illustrates a perspective view of the payload delivery system corresponding to that shown in FIG. 9A, showing the system after folding the attached stabilizer in a forward manner along the length of the payload cup, as it would appear in a pre-launched configuration, for example, when loaded into a cartridge.

FIG. 9C illustrates a sectional view of a representative embodiment of a payload delivery system in its pre-launched configuration showing the payload cup, the forward folded stabilizer, and the connector, in which the aft end of the payload cup is crimped closed. In the illustrated embodiment, the connector is a blind rivet that holds the forward folded stabilizer to the crimped end of the payload cup.

FIG. 9D illustrates a sectional view of a representative embodiment of a payload delivery system in its pre-launched configuration showing the payload cup, the forward folded stabilizer, the pre-formed gas seal, and the connector, in which the aft end of the payload cup is crimped closed. In the illustrated embodiment, the connector is a blind rivet that holds the forward folded stabilizer to the crimped end of the payload cup, in which the pre-formed gas seal forms the head of the rivet connector and is an integral part thereof, such that the unitary gas seal-rivet attaches to the stabilizer. This arrangement can also represent those payload delivery systems in which the pre-formed gas seal is a separate component that is attached to the payload cup having a crimped aft end to the stabilizer with the rivet connector.

FIG. 11C further illustrates a separate pre-formed gas seal 250, which can be used along with the stabilized payload cup 200 to both form the bottom or base of the payload cup on which the payload will sit and to provide its obturating function. In FIG. 11D, the gas seal has been inserted to as to fit inside the folded stabilized payload cup 200.

DETAILED DESCRIPTION OF THE INVENTION

This disclosure provides for a payload delivery system for use in cartridges or launched in any fashion, the system including a cup-shaped stabilizer that assists in the discharge, launching, and ballistic performance of the payload. In some aspects, the stabilizer can serve as a flight stabilizer for any payload or payload cup to which it is attached. If desired and in some embodiments, other components such as spacers can be used along with the projectiles and the stabilizer. The cup-shaped stabilizer can be adjusted to achieve different degrees of drag for a desired ballistic performance. In other aspects, the cup-shaped stabilizer can contain the payload in its own cavity and function as its own type of payload container or payload cup. In this aspect, after a certain distance downrange, the stabilizer can open and peel back to cleanly separate from its payload. The potential advantages of this payload delivery system includes using relatively low-cost components, avoiding complicated structures, generally eliminating the high capital cost of new tooling, and affording an ease of manufacturing.

Portions of this disclosure discuss shotshells as exemplary cartridge systems that can use the disclosed components, and these components may be discussed in terms of their shotshell applications. However, this disclosure relates to virtually any type of launching system such as a cartridge system and components of such launching systems and cartridge systems for delivering any number of payload types. For example, the components and methods disclosed here are equally amenable to constructing shotshell cartridges which launch their payload at high velocities, as they are to constructing cartridges for launching liquid, powder or gel payloads at low velocities. Thus, the disclosed payload delivery systems are applicable to chemical, pyrotechnic, signaling, non-lethal, and other complex cartridge systems, as well as shotshells with bird shot, buck shot, or slug projectiles. Accordingly, the disclosure and the claims are not limited to any particular type of cartridge delivery system.

General Structure of the Payload Delivery System

In one aspect, there is provided a payload delivery system comprising, in its pre-launched configuration:

a) a payload cup having an open fore end, a closed aft end, and a cylindrical side wall defining a cavity;

b) a cup-shaped stabilizer coaxially aligned with the payload cup, having an open fore end, a closed aft end, and a side wall comprising a plurality of vanes defined by a plurality of cuts in the side wall;

wherein the payload cup is nested within the stabilizer, such that the payload cup aft end is adjacent and attached to the stabilizer aft end.

c) optionally, a connector element that unites the payload cup and the cup-shaped stabilizer.

Representative embodiments illustrated in the figures are generally shown with a connector element to unite the payload cup and the cup-shaped stabilizer.

Figure 1A:
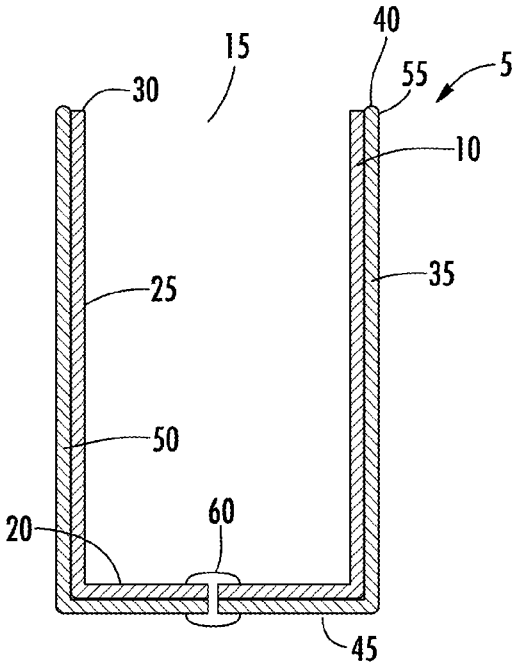
FIG. 1A illustrates a sectional view of a representative embodiment of a payload delivery system in its pre-launched configuration showing the payload cup, the forward folded stabilizer, and in this embodiment a connector, as provided by this disclosure.

FIG. 1A illustrates a sectional view of a representative embodiment of a payload delivery system 5 in its pre-launched configuration, the payload delivery system including a payload cup 10 and a forward folded stabilizer 35, also referred to as a cup-shaped stabilizer, and in this embodiment a connector, as provided by this disclosure. Payload cup 10 has an open forward or fore end 15, a closed rearward or aft end 20, and a cylindrical side wall 25 defining a cavity that terminates at a rim 30 contiguous with the open fore end 15. The forwarded folding stabilizer 35 is coaxially aligned with the payload cup 10 and has an open forward or fore end 40, a closed rearward or aft end 45, and a side wall 50 defining a cavity that terminates at an edge 55 contiguous with the open fore end 40. The side wall 50 comprises a series of cut or slits therethrough, which are not shown in this figure. As illustrated, the payload cup rearward end 20 is located within the cup-shaped stabilizer cavity and adjacent the stabilizer rearward end 45, such that the payload cup is nested within the cup-shaped stabilizer. That is, the bottom of the payload cup 10 generally sits within and at the bottom of the cup-shaped, forward folded stabilizer 35.

In FIG. 1A, a connector 60 joins or unites payload cup 10 and cup-shaped stabilizer 35 such that the bottoms of these components are maintained in this contiguous and adjacent situation after launch, and are not separated during flight. In this manner, the stabilizer imparts its stabilizing and drag effect as it unfolds and inverts during flight. While a simple rivet type connector 60 is illustrated in FIGS. 1A-D, the payload delivery system of this disclosure is not so limited, as the connector can be selected from or alternatively can comprise a rivet, a screw, a staple, a pin, a bolt, an anchor, an adhesive, a tack, or a nail, or any similar structure that can unite the payload cup 10 and cup-shaped stabilizer 35. However, the payload cup aft end and the stabilizer aft end can be connected or attached by any means, and attachment does not require a connector component. For example, the payload cup and the cup-shaped stabilizer could be attached by a melting process, by a punching method, by a sonic weld process, and the like. Moreover, additional structures and functions can be incorporated into the connector 60, such as a point or edge that is exposed to the inside of the payload cup at the aft end, that provides a means to puncture or rupture a capsule that houses a gel or liquid payload contained within the stabilized payload cup.

Figure 1C:
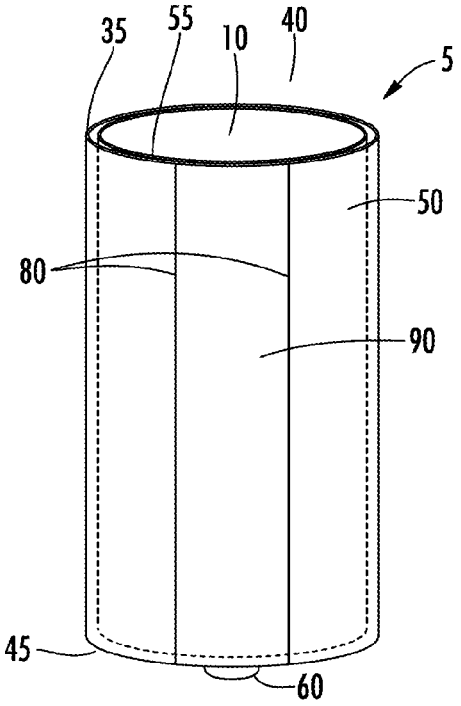
FIG. 1C illustrates a perspective view of a representative embodiment of a payload delivery system in its pre-launched configuration, corresponding to the embodiment shown in FIG. 1A, showing the forward folded stabilizer that surrounds the payload cup, the stabilizing vanes extending the full length of the payload cup.
Figure 1B:
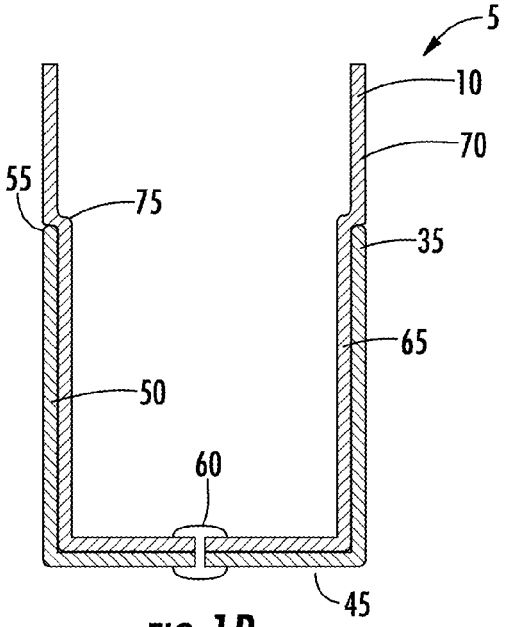
FIG. 1B illustrates a sectional view of a representative embodiment of a payload delivery system in its pre-launched configuration showing the payload cup, the forward folded stabilizer, and in this embodiment a connector, as provided by this disclosure, and highlighting an embodiment with a payload cup having a recessed aft portion.

FIG. 1B illustrates a sectional view of another representative embodiment of a payload delivery system 5 in its pre-launched configuration, showing the payload cup 10, the cup-shaped stabilizer 35, and in this embodiment a connector 60. In this embodiment, the payload cup 10 has a recessed aft portion 65, a non-recessed forward portion 70, and an annular step 75 that forms the transition between the two portions. The recessed aft portion 65 has a smaller diameter than forward portion 70, and the forward portion can remain in contact with the inner wall of the cartridge when loaded. In some embodiments, the cup-shaped stabilizer 35 can surround or fit around the recessed aft portion 65 of the payload cup when forward folded, such that the forward portion 70 of payload cup has approximately the same outer diameter as the cup-shaped stabilizer 35 when it is installed about the recessed aft portion 65. The embodiment shown in FIG. 1B shows the cup-shaped stabilizer edge 55 situated flush against the annular step 75, which maintains the approximately same outer diameter in the forward portion 70 as in the recessed aft portion 65 with the stabilizer side wall 50 installed. In this typical embodiment, the stabilizer side wall 50 is approximately the same length as the recessed aft portion 65 side wall, although other embodiments provide that the cup-shaped stabilizer side wall 50 can be longer or shorter than the aft portion 65 side wall. The side wall 50 comprises a series of cut or slits therethrough, which are not shown in this figure. A connector 60 of any type can be employed to join the payload cup 10 and cup-shaped stabilizer 35, or as disclosed herein, the payload cup and cup-shaped stabilizer can be joined without a discrete connector element.

Figure 1D:
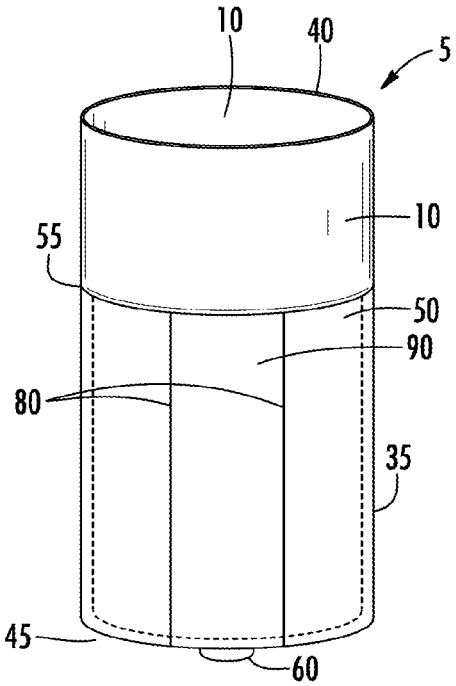
FIG. 1D illustrates a perspective view of a representative embodiment of a payload delivery system in its pre-launched configuration, corresponding to the embodiment shown in FIG. 1B, showing the forward folded stabilizer that surrounds a portion of the payload cup, the stabilizing vanes extending the length of the recessed aft portion of the payload cup

FIGS. 1C and 1D illustrate perspective views of representative embodiments of a payload delivery system in its pre-launched configuration 5, showing the cup-shaped stabilizer 35 and the relative arrangement of the payload cup 10 and stabilizer 35 components. In both FIGS. 1C and 1D, the cup-shaped stabilizer fore end 40, aft end 45, cut cylindrical side wall 50 comprising vanes 90, and stabilizer edge 55 are seen in perspective. The vanes 90 are defined by the cuts 80 in the stabilizer side wall 50, and longitudinal cuts that extend from the stabilizer aft portion 45 to the forward edge 55 of the stabilizer are particularly illustrated in FIGS. 1C and 1D. The perspective view shown in FIG. 1C corresponds to the representative embodiment shown in FIG. 1A, showing the forward folded stabilizer that surrounds the payload cup, the stabilizer vanes extending the full length of the payload cup. The perspective view shown in FIG. 1D corresponds to the representative embodiment shown in FIG. 1B, showing the forward folded stabilizer that surrounds a portion of the payload cup, the stabilizer vanes extending the length of the recessed aft portion of the payload cup.

In one aspect, and while not limiting, the cut side wall of the cup-shaped stabilizer defining the vanes can extend any portion of the length of the cylindrical side wall of the payload cup and in some embodiments, can even extend greater than the length of the cylindrical side wall of the payload cup. Some embodiments include a cup-shaped stabilizer side wall and vanes that generally can extend the entire length of the cylindrical side wall of the payload cup. The use of these substantially full-length stabilizer side walls and vanes generally allows the use of thinner payload cups than typically would be required if no double-layer comprising stabilizer material and payload cup material were used. A construction in which the stabilizer side wall and the payload cup overlap in their pre-launched configuration provides the temporary lamination effect of the forward folded vanes of the stabilizer and the payload cup for strength and allows relatively thin materials to be used for both the stabilizer and payload cup if desired.

By way of example, the cut side wall of the stabilizer and the vanes defined by the cuts in the side wall can extend about 10% the length of the cylindrical side wall of the payload cup; alternatively, about 20%; alternatively, about 30%; alternatively, about 40%; alternatively, about 50%; alternatively, about 60%; alternatively, about 70%; alternatively, about 80%; alternatively, about 90%; alternatively, about 100%; alternatively, about 110% the length of the cylindrical side wall of the payload cup. In some embodiments, the cut side wall of the stabilizer and the vanes defined by the cuts in the side wall can extend at least 5% the length of the cylindrical side wall of the payload cup. In another aspect, the cut side wall of the cup-shaped stabilizer can extend at least 10%, at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or about 100%, the length of the cylindrical side wall of the payload cup. Typically, the cut side wall of the stabilizer and the vanes defined by the cuts in the side wall can extend at least 75%, at least 80%, at least 85%, at least 90%, or at least 95% the length of the cylindrical side wall of the payload cup. In further embodiments, the cut side wall of the cup-shaped stabilizer can extend 100% or greater than 100% the length of the cylindrical side wall of the payload cup if it is desired to provide additional material forward of the aft portion of the payload cup that can be folded over the open fore end of the payload cup.

FIGS. 1A-D illustrates another aspect of this disclosure, namely that the payload cup 10 is not required to have slits in its cylindrical side wall for the wad structure to function. Slits must be either molded or cut into conventional payload cups and the consistent molding or cutting of slits in conventional cups can be difficult. Therefore, the present payload cup, which does not require slits, affords improvements in ease of manufacturing and costs as compared to conventional wad structures. Slits are not required in the present payload cup because drag is provided by the cup-shaped stabilizer having vanes that unfold and invert during flight, rather than from the petals of a conventional slit payload cup that open during flight. Moreover, the absence of slits in the payload cup component of the present payload delivery system provides better barrel protection when used in shotshells, particularly for hard shot such as steel, because there are no cut or weakened areas that can allow hard pellets to work through as they are accelerated down the barrel, thereby making contact with barrel and/or choke. While the disclosed payload delivery system does not require slits in the payload cup to function, the payload cup can incorporate slits, cut-outs, perforations, and the like, if so desired. In this case, structures such as perforations can impart a greater stabilizing function of the cup-shaped stabilizer as the vanes open and invert.

In accordance with one further aspect of this disclosure, there is provided a payload delivery system comprising, in its pre-launched configuration:

a) a payload cup having an open fore end, a closed aft end, and a cylindrical side wall defining a cavity;

b) a cup-shaped stabilizer coaxially aligned with the payload cup, having an open fore end, a closed aft end, and a side wall comprising a plurality of vanes defined by a plurality of cuts in the side wall, that terminates at an edge contiguous with the open fore end;

wherein the payload cup is nested within the stabilizer, such that the payload cup aft end is adjacent and attached to the cup-shaped stabilizer aft end; and c) optionally, a connector that unites the payload cup and the cup-shaped stabilizer;

further comprising:

d) an obturating component adjacent the aft end of the cup-shaped stabilizer, comprising a pre-formed gas seal or an obturating medium.

In this aspect, the payload delivery system can further comprise: d) a pre-formed gas seal adjacent the aft end of the cup-shaped stabilizer and coaxially aligned with the payload cup and the stabilizer, wherein the connector further unites the gas seal with the payload cup and the cup-shaped stabilizer. When the pre-formed gas seal is further united in this manner, the stabilizer vanes unfold and invert over the pre-formed gas seal as the entire delivery system including the gas seal component is launched downrange. In other aspects, it is not necessary to attach the pre-formed gas seal to the combined and attached stabilizer and payload cup, as the combined stabilizer and payload cup simply can sit or be situated forward of the pre-formed gas seal in a cartridge. In another aspect, and in contrast to including a pre-formed gas seal, the payload delivery system can further comprise: d) an obturating medium adjacent the aft end of the cup-shaped stabilizer. This so-called "wadless" technology, which does not employ a pre-formed gas seal, is further described herein.

Forward Folding Stabilizer Structure

An aspect of this disclosure is provided in the structure and composition of the cup-shaped and forward folding stabilizer. For example, in one aspect, the forward folding stabilizer can be made of, or alternatively can comprise, paper, at least one polymer, or fabric. In its pre-launched configuration, the stabilizer is cup-shaped, and the vanes are forward folded, somewhat reminiscent of an umbrella, in which the stabilizer has an open top (fore end), a closed bottom (aft end), and a cut side wall that can be cylindrical to slightly frustoconical. The stabilizer sidewall 50 in the pre-launched stabilizer 35 comprises a plurality of vanes or ribbons defined by a plurality of cuts in the side wall, generally extending from the aft end 45 of the stabilizer 35 to the stabilizer edge 55. The cup-shaped stabilizer 35 can impart a stabilizing effect when it is attached to a payload cup, because the stabilizer structure includes forward folded vanes 90 that open or unfold and invert in a controlled and symmetric fashion during flight. As a result, the payload delivery system as a whole can be decelerated in a highly stable manner and release its payload in a controlled and tailored manner.

The stabilizer side wall 50 can include any number, sizes, and shapes of cuts, including a plurality of longitudinal or substantially longitudinal cuts therein. By the term substantially longitudinal, it is intended that the cuts do not vary more than 30 degrees from longitudinal; alternatively, not more than 25 degrees from longitudinal; alternatively, not more than 20 degrees from longitudinal; alternatively, not more than 15 degrees from longitudinal; alternatively, not more than 10 degrees from longitudinal; or alternatively, not more than 5 degrees from longitudinal. In one aspect, the cut side wall of the stabilizer can be cut in a fashion such that the vanes cover substantially all the side wall area of the payload cup when forward folded, because each vane is flush against a neighboring vane. Alternatively, the cut side wall of the stabilizer can be structured such that at least some of the vanes are missing, shaped in different ways, have gaps between the vanes such that each vane is not flush against a neighboring vane, and other configurations. Still alternatively, the cut side wall of the stabilizer can be structured such that at least some of the vanes overlap each other, which can aid in the sabot function.

The use of forward folding stabilizers having the disclosed structures can afford certain advantages in manufacturing the disclosed cartridges. For example and while not intending to be limiting, the stabilizer component can be manufactured from flat sheets of suitable materials. The desired shape of the material can be die cut or punched from flat sheets and subsequently cut in the appropriate manner using established technology to create the stabilizing vanes or ribbons. The manufacturing advantages of using flat sheets include the relative low cost of flat sheet materials as compared to other forms. Further, using flat sheets avoids the limitations of injection molding in terms of high cost, restrictions in compositions suitable for molding, and initial capital costs for tooling.

Figure 2A:
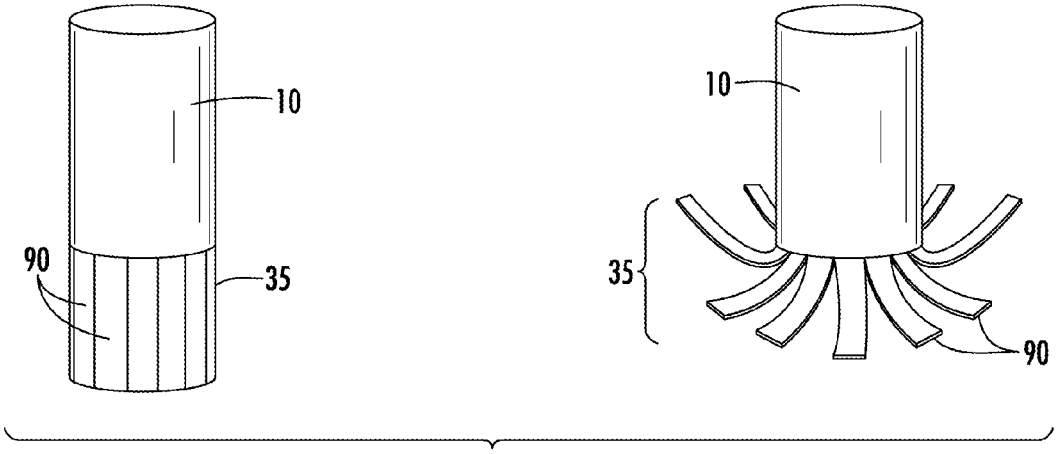
FIGS. 2A-C illustrate perspective views of three different payload delivery systems according to this disclosure, each having a different type of forward folded stabilizer, and each stabilizer extending a substantial portion of the length of the payload cup. The left side views correspond to a post-launching configuration showing the stabilizers after they unfold and invert during flight. The right side views correspond to pre-folded stabilizers prior to loading into a cartridge, and also demonstrate the stabilizers part way through the unfolding stage during flight.
Figure 2B:
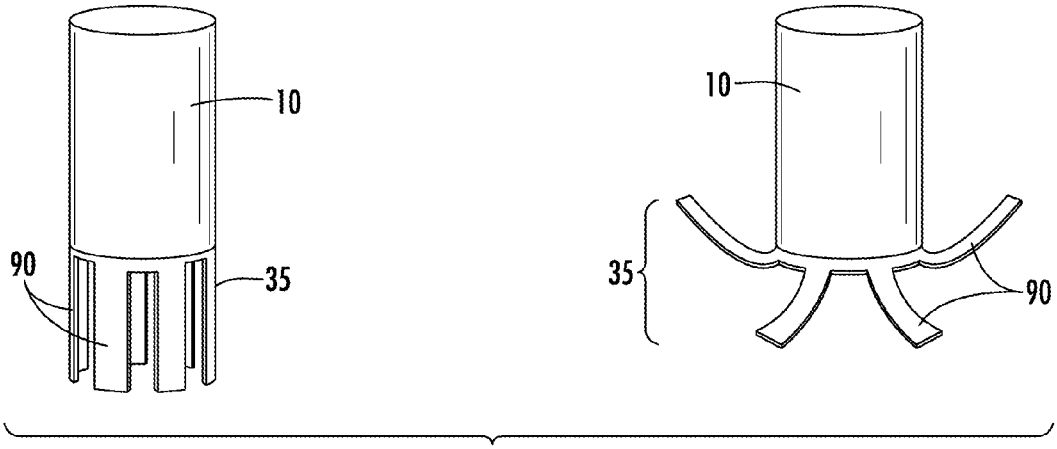
Figure 2C:
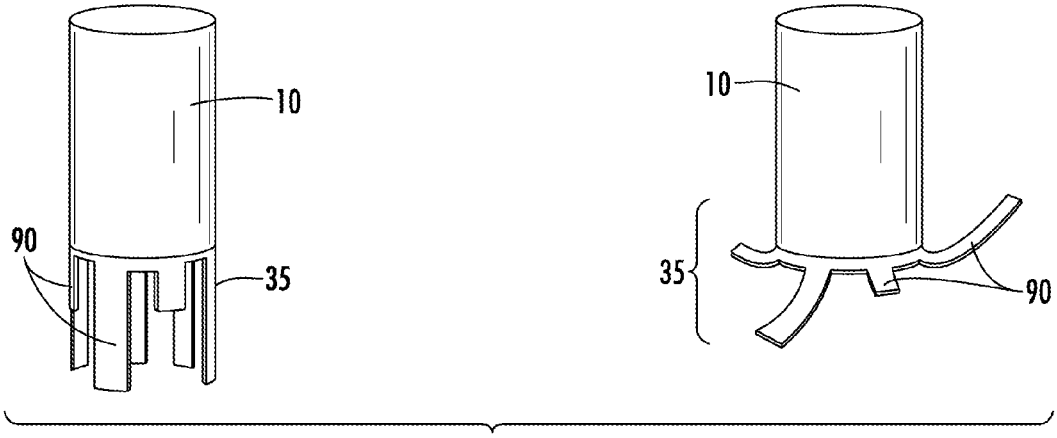

FIGS. 2A-C illustrate perspective views of three different payload delivery systems according to this disclosure, each having a different type of forward folded stabilizer 35, and each stabilizer having vanes 90 extending a substantial portion of the length of the payload cup 10. The left side views correspond to a post-launching configuration showing the stabilizers after they unfold and invert during flight. The right side views correspond to pre-folded stabilizers prior to loading into a cartridge, and also demonstrate the stabilizers part way through the unfolding stage during flight. FIG. 2A illustrates a payload delivery system with a forward folding stabilizer having identical vanes, in which no vanes or fins have been removed, perforated, or shortened. FIG. 2B illustrates a payload delivery system with a forward folding stabilizer in which alternating vanes have been removed. FIG. 2C illustrates a payload delivery system with a forward folding stabilizer in which alternating vanes have been removed and every other remaining vane has been shortened.

Figure 3A:
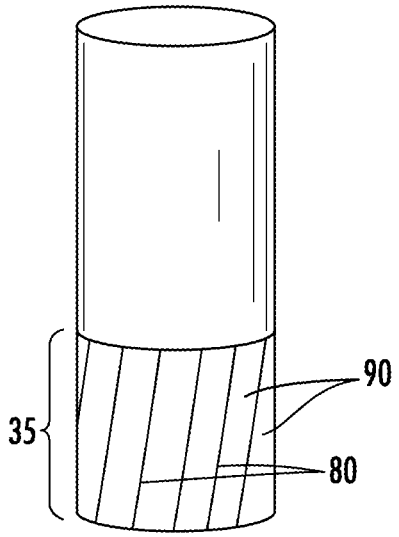
FIGS. 3A-B illustrate perspective views of two different payload delivery systems according to this disclosure, each having a different alternative type of forward folding stabilizer, and each stabilizer extending a substantial portion of the length of the payload cup. Each figure corresponds to a post-launching configuration showing the stabilizer after unfolding and inverting during flight.
Figure 3B:
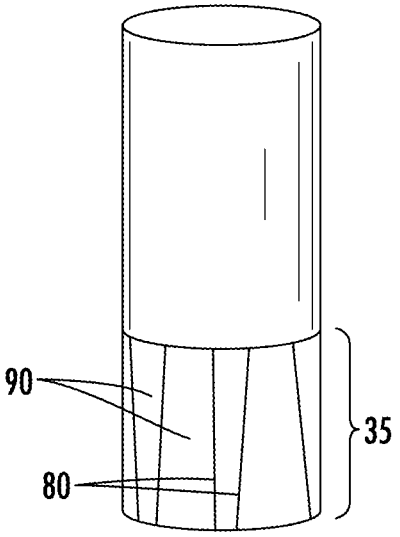

FIGS. 3A-B illustrate perspective views of two different payload delivery systems according to this disclosure, each having a different alternative type of forward folding stabilizer, and each stabilizer extending a substantial portion of the length of the payload cup. Each figure corresponds to a post-launching configuration showing the stabilizer after unfolding and inverting during flight. FIG. 3A illustrates an alternative forward folded stabilizer 35 in which the stabilizer side wall comprises a plurality of vanes 90 defined by a plurality of parallel, but non-longitudinal, cuts 80 in the side wall 50. That is, the cuts in FIG. 3A are not parallel to the line of flight. FIG. 3B illustrates an alternative forward folded stabilizer in which the stabilizer side wall comprises a plurality of vanes defined by two types of non-longitudinal cuts (not parallel to the line of flight) in the side wall in which alternating cuts are parallel.

Figure 4A:
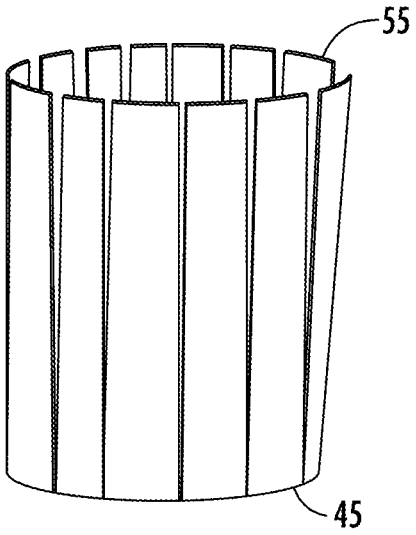
FIGS. 4A-C illustrate various embodiments of the forward folding component of the cartridge system, demonstrating methods by which cuts can be made in the stabilizer side wall. These embodiments are representative of those that can be used when the forward folding component is deployed as a stabilizer in combination with a separate payload cup to which it is attached and when it is used as a stand-alone stabilizer cup, itself containing the payload.
Figure 4B:
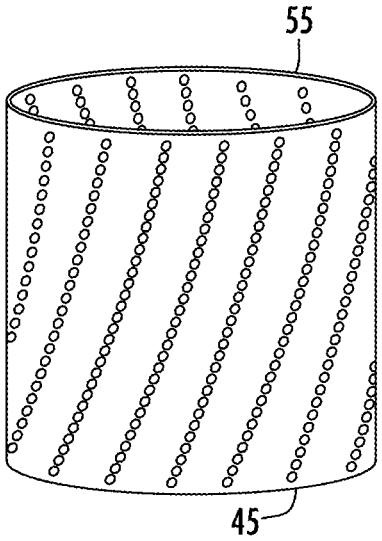
Figure 4C:
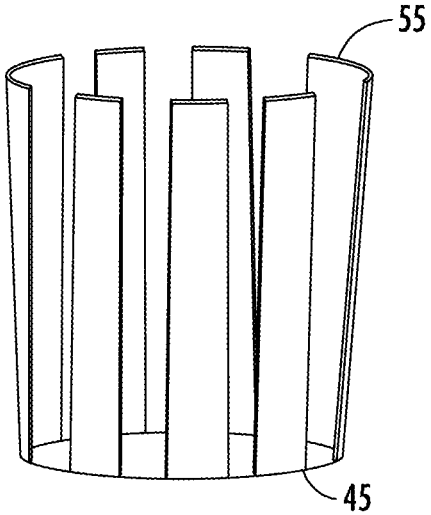

Each of FIGS. 4A-C further illustrate various aspects of the forward folding component, demonstrating methods by which cuts can be made in the stabilizer side wall. These aspects and embodiments are representative of the forward folding component used as a stabilizer in combination with a separate payload cup to which it is attached and when it is deployed as stand-alone or "stabilizer cup", itself containing the payload in the absence of a separate payload cup component.

Therefore, in accordance with an aspect, this disclosure provides a payload delivery system that can comprise, in its pre-launched configuration:

a) a cup-shaped stabilizer having an open fore end, a closed aft end, and a side wall comprising a plurality of vanes defining a cavity and defined by a plurality of longitudinal cuts in the side wall;

b) an obturating component adjacent the stabilizer aft end; and c) at least one payload contained within the cavity of the stabilizer.

This aspect does not require a separate payload cup and cup-shaped stabilizer in contrast to that shown FIGS. 1A-D. The FIGS. 4A-C constructions can be particularly useful for launching certain projectiles such as powders, gels, liquids contained in a breakable or rupturable container, and the like, for example, at relatively low velocities. In these situations, the stabilizer cup can provide a clean separation of the cup from the payload. Moreover, the FIGS. 4A-C constructions can be used for launching certain solid projectiles to which they are attached and therefore function as stabilizing components for the solid projectile. It is also not necessary to attach the forward folding component of FIGS. 4A-C to a solid projectile, in which case it can serve a sabot function and protection function. Again, the particular structural features cut in the side wall are not limited to simple slits as shown in FIG. 4A, but can encompass a wide variation in structures.

While each of FIGS. 4A-5C generally show the cuts, perforations, and/or cut outs extending from the stabilizer edge 55 to the stabilizer aft end 45, embodiments in which cuts, perforations, cut outs, and the like that extend a portion of the distance from the stabilizer edge 55 to the stabilizer aft end 45 are also envisioned and encompassed by this disclosure. Moreover, features that are longitudinal, that is, parallel to the initial payload line of flight, and those that are not longitudinal are also envisioned. FIG. 4A provides a perspective view of a forward folding component that includes longitudinal slits through the stabilizer side wall. FIG. 4B provides a perspective view of a forward folding component that includes perforations through the stabilizer side wall. FIG. 4C provides a perspective view of a forward folding component that includes cut-outs through the stabilizer side wall with different vane lengths. By further example, variously-shaped and sized cuts, cut-outs, slits, holes, perforations, and the like, whether generally longitudinal, transverse, or otherwise, or combinations thereof, can be used to impart additional stabilizing influence on the payload delivery system as it is launched. In this aspect, for example, perforations or cut-outs can be employed to provide various degrees of stability during flight, as a function of the number, size, and patter of the perforations or cut-outs. Thus, the features shown in FIGS. 4A-C are merely illustrative of any number, size, shape, and pattern of cuts, cut-outs, perforations, and the like that can be included in the forward folding component for their stabilizing function.

The cup-shaped and forward folding stabilizer used in any disclosed embodiments of the payload delivery systems can be made of, or alternatively can comprise, any material that can be folded and cut, including for example, paper, coated paper, paper composites, woven fabric, non-woven fabric, a wide range of polymers and plastics, various composites, various laminates, and the like. For example, the forward folding stabilizer can be made of, or alternatively can comprise, a polyolefin material, such as homopolymers or copolymers of polyethylene, polypropylene, and/or other olefin monomers. Paper that is coated on one or both sides with various polymers, resins, or other materials can also be used. Further, the stabilizer can be made of, or alternatively can comprise, various grades and types of paper, including any number of laminates or composites using such paper. In a further aspect, the stabilizer can be made of or alternatively can comprise a material that is from about 0.1 mil to about 25 mil in thickness, for cartridges that are generally applicable to being discharged while hand-held. However, this range is merely illustrative, as the thickness and size of the stabilizer can be altered as necessary to accommodate the requirements of the cartridge size, desired initial velocity and/or pressure on launching, and the like. Generally, there is no limit or restriction on the material thickness or material type that can be used according to this disclosure, as long as that sample can be folded and cut into a suitable structure and used as provided herein.

While materials such as nonwovens comprising spun polyolefin fibers such as Tyvek® can be used as the stabilizer, for most applications, the cup-shaped stabilizer can be made of paper or a plastic material of some type, including materials that comprise paper or plastic. Suitable paper can include a wide range of basis weights and can be coated or uncoated. By way of example, a paper stabilizer can be coated to improve functional properties such as strength or stiffness or rigidity. Numerous paper coatings and their functional effect on the coated paper properties are well-understood in the paper art. Typical ingredients used in formulating a paper coating composition can include water, inorganic fillers, dispersants for the filler, binders and optional co-binders, water retention aids, rheology modifier to yield the proper viscosity profile to apply the coating, and the like.

The Payload Cup

Generally, the materials used to construct the payload cup are well known and varied, and the payload delivery system is not limited to a particular material. For example, the payload cup can be made of, or alternatively can comprise, a range of polymers or plastics, paper including paper composites and laminates, combinations of polymers and paper such as coated paper or laminates of paper and polymers, and the like. A number of composite or laminate materials can be used. Unlike the cup-shaped stabilizer, the payload cup shown as 10 in FIGS. 1-4, retains its shape upon being launched. By way of example, the payload cup can be made of or alternatively can comprise a polyolefin material, such as homopolymers or copolymers of polyethylene, polypropylene, and/or other olefin monomers. Paper materials that are relatively stiff such as paper that is coated with various polymers, resins, or other materials can also be used, as can convoluted paper and other types of laminated materials.

Payload Delivery System Including an Integral or Separate Gas Seal

Many modern cartridges include a gas seal or obturating component, either as a separate element in the cartridge or formed as an integral part of projectile or payload container. For example, modern shotshell cartridges typically include a gas seal as a separate element in the cartridge or formed as an integral part of the wad and payload cup (shot cup) itself As appreciated by the skilled artisan, the payload delivery system of this disclosure also can use any type of gas seal element known in the art. For example, a discrete pre-formed gas seal can be used to separate the powder charge from the payload delivery system and payload. Alternatively, so-called wadless technology described in U.S. Pat. No. 7,814,820 and U.S. Patent Application Publication No. 2011/0017090 by Menefee, both of which are incorporated herein by reference in their entireties, works well with the payload delivery system of this disclosure. In addition, embodiments having an integral gas seal component that is part of the payload delivery system itself also work well and are described here. For example, the connector that is used to attach the payload cup with the stabilizer can have a gas seal portion or "head" that is directed toward the propellant when the connector is attached.

Figure 5A:
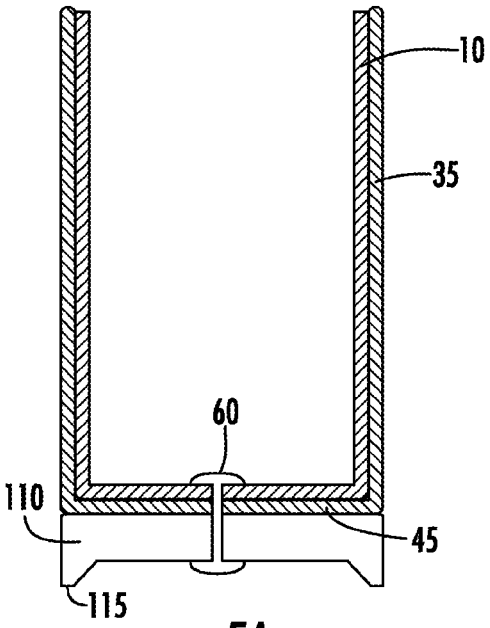
FIG. 5A illustrates a sectional view of a representative embodiment of a payload delivery system in its pre-launched configuration showing the payload cup, the forward folded stabilizer, a pre-formed gas seal, and the connector, as provided by this disclosure.
Figure 5B:
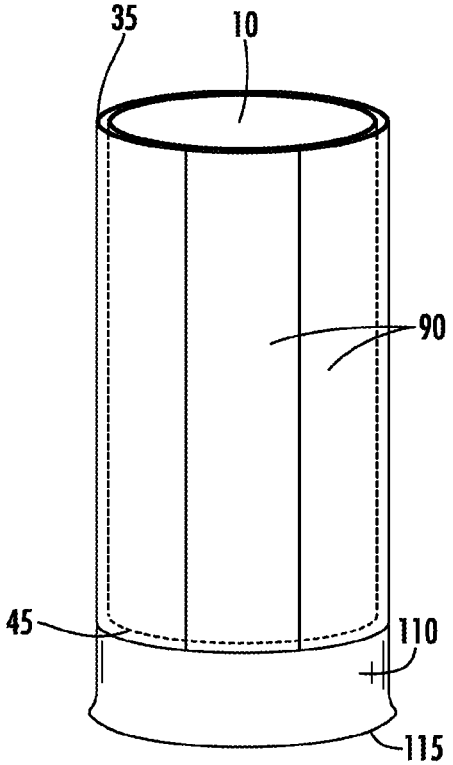
FIG. 5B illustrates a perspective view of a representative embodiment of a payload delivery system in its pre-launched configuration corresponding to that shown in FIG. 5A, showing the relative arrangement of a forward folded stabilizer which surrounds and extends the full length of the payload cup, and including a pre-formed gas seal. This arrangement represents those payload delivery systems that either: 1) attach the pre-formed gas seal to the payload cup and the forward folded stabilizer; or 2) attach only the payload cup and the forward folded stabilizer, the combination of which sits atop a pre-formed gas seal.
Figure 5C:
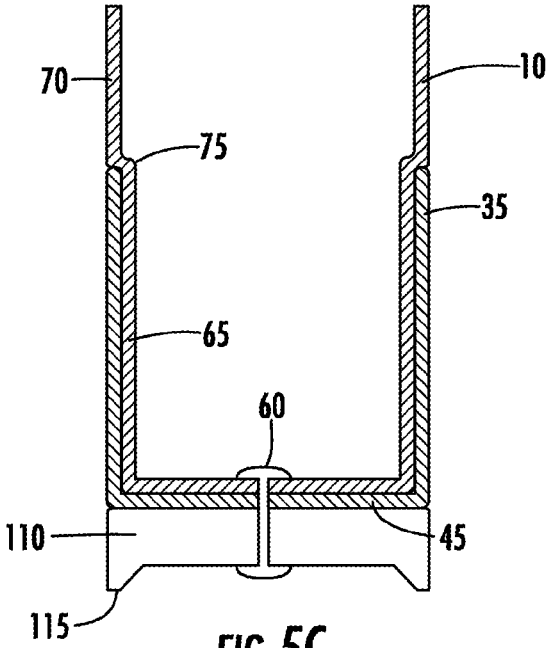
FIG. 5C illustrates a sectional view of a representative embodiment of a payload delivery system in its pre-launched configuration showing the payload cup having a recessed aft portion, a forward folded stabilizer extending the length of the recessed aft portion, a pre-formed gas seal, and the connector, as provided by this disclosure.

FIGS. 5A-C illustrate representative aspects and embodiments of a payload delivery system in its pre-launched configuration, that includes a pre-formed gas seal 110 as an attached component of the payload delivery system that further includes the payload cup 10 and the cup-shaped stabilizer 35 as previously described. FIG. 5A illustrates a sectional view of an example of a payload delivery system in its pre-launched configuration showing the payload cup 10, the forward folded stabilizer 35, a pre-formed gas seal 110, and the connector 60, as provided by this disclosure. In FIG. 5A, the pre-formed gas seal 110 is coaxially aligned with and oppositely directed to the payload cup 10 and the cup-shaped stabilizer 35, adjacent the rearward or aft end 45 of stabilizer 35. Gas seal 110 has a side wall that generally defines a gas-sealing skirt 115. If desired, and as illustrated in FIG. 5A, the payload cup, cup-shaped stabilizer, and gas seal can be united by a connector 60, for example, the rivet-type connector shown in FIG. 5A, which is typically a plastic or polymer material. Any type of connector can be used in this aspect. However, this connection of the gas seal to the remainder of the payload delivery system is not required.

FIG. 5B illustrates a perspective view of representative aspects of a payload delivery system in its pre-launched configuration corresponding to that shown in FIG. 5A, showing the relative arrangement of a stabilizer 35 with its forward folded vanes 90 which surround and extend the full length of the payload cup, and further includes a pre-formed gas seal. This arrangement represents those payload delivery systems that either: 1) attach the pre-formed gas seal to the payload cup and the forward folded stabilizer, corresponding to the FIG. 5A arrangement; or 2) attach only the payload cup and the forward folded stabilizer, the combination of which sits atop a pre-formed gas seal. Thus, some embodiments can attach the gas seal to the aft end of the combined and nested payload cup and stabilizer, while other embodiments can use a separate gas seal that is not attached or integral to the payload cup and cup-shaped stabilizer combination.

FIG. 5C illustrates a sectional view of representative aspects of a payload delivery system in its pre-launched configuration showing the payload cup 10 having a recessed aft portion 65, a stabilizer 35 having forward folded vanes 90 extending the length of the recessed aft portion, a pre-formed gas seal, and the connector, as provided by this disclosure.

Thus, payload cup 10, cup-shaped stabilizer 35, and gas seal 110 can all be united by a connector 60, for example, the rivet-type connector shown in FIG. 5A and FIG. 5C, which typically can be a plastic or polymer material, for cost and ease of manufacturing and use purposes. As before, connector 60 of any type can be used to join the payload cup, stabilizer, and gas seal, for example, a rivet, a screw, a staple, a pin, a bolt, a brad, an anchor, an adhesive, a tack, or a nail of some type can be used.

Unfolding and Inversion of the Cup-shaped Stabilizer During Flight

Figure 6A:
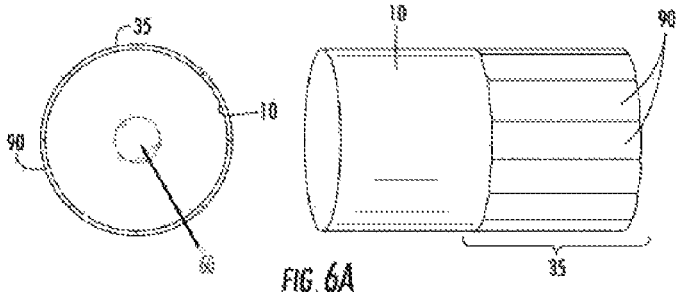
FIGS. 6A-C illustrate a progression of end-on views of a downrange observer (left) and perspective views (right) of the payload delivery system, without showing a particular payload, as the forward folded stabilizer unfolds and inverts to slow the payload delivery system in a stabilized manner. The particular embodiment illustrated has a forward folded stabilizer with eight vanes, extending a portion of the length of the payload cup, in which the stabilizer is attached to the payload cup with a connector. The payload delivery system is illustrated before or instantly after launching (FIG. 6A, time 1), early in the unfolding stage (FIG. 6B, time 2), and later in the unfolding and inversion stage (FIG. 6C, time 3).
Figure 6B:
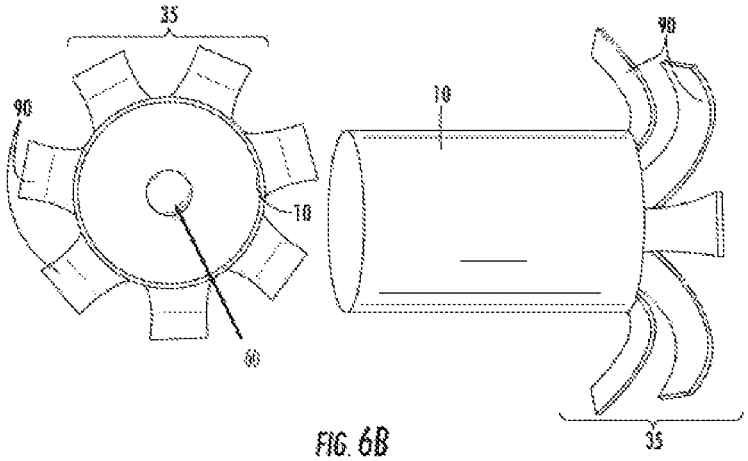
Figure 6C:
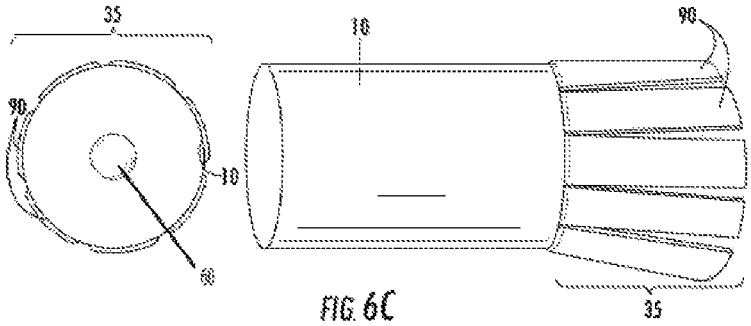

With reference to the general structure of the payload delivery system described herein, FIGS. 6A-C illustrate a progression of end-on views of a downrange observer (left) and perspective views (right) of the payload delivery system, without showing a particular payload, as the forward folded stabilizer unfolds and inverts to slow the payload delivery system in a stabilized manner. The particular embodiment illustrated has a forward folded stabilizer 35 with eight vanes 90, extending a portion of the length of the payload cup 10, according to various disclosed embodiments. Also illustrated is a connector 60 by which the stabilizer 35 is attached to the payload cup 10. The payload delivery system is illustrated before or instantly after launching (FIG. 6A, time 1), early in the unfolding stage (FIG. 6B, time 2), and later in the unfolding and inversion stage (FIG. 6C, time 3). FIG. 6C also illustrates the vanes trailing from the aft edge of the payload cup as would occur when a pre-formed gas seal is attached to the aft end of the stabilizer and the payload cup, such that the vanes drape over the gas seal and naturally trail from the payload cup aft edge. While not theory bound, it is believed that the stabilizer vanes may function in a similar manner as a shuttlecock in that they add high drag and high stability to the wad structure as it releases its projectile or payload.

Figure 7A:
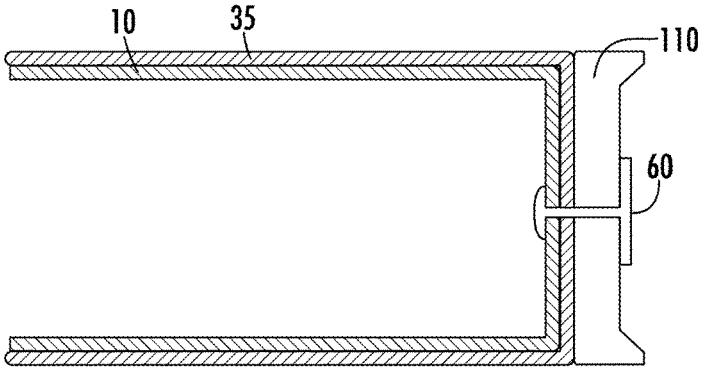
FIGS. 7A-C illustrate a progression of sectional views of the payload delivery system with an attached pre-formed gas seal, without showing a particular payload, as the forward folded stabilizer unfolds and inverts to slow the payload delivery system in a stabilized manner. The payload delivery system is illustrated before or instantly after launching (FIG. 7A, time 1), early in the unfolding stage (FIG. 7B, time 2), and later in the unfolding and inversion stage (FIG. 7C, time 3).
Figure 7B:
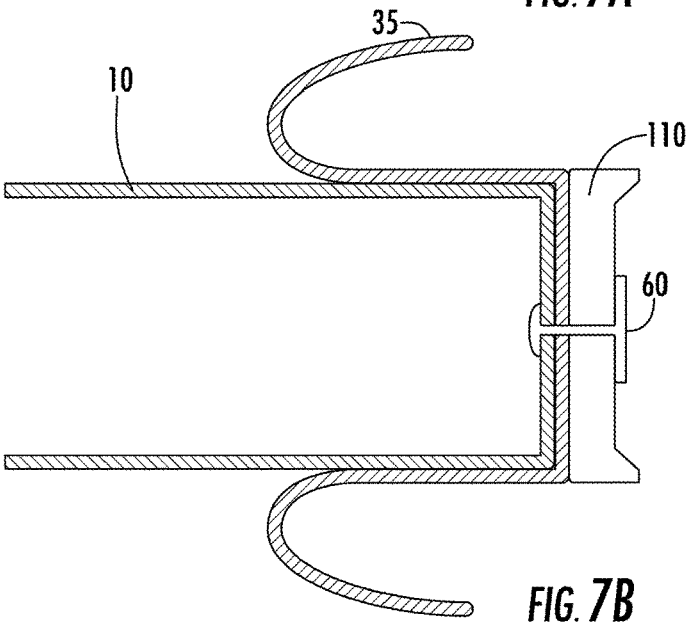
Figure 7C:
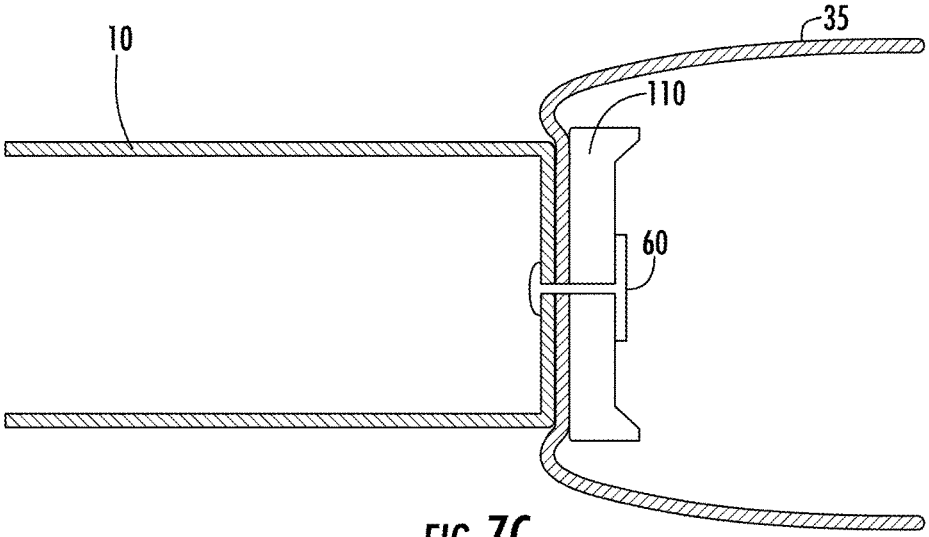

FIGS. 7A-C illustrate sectional views of the progression of the payload delivery system, which evolves over time and downrange distance, with an attached pre-formed gas seal, without showing a particular payload. These figures demonstrate how the vanes of the forward folded stabilizer unfold and invert such that they are rearward folded to slow the payload delivery system in a stabilized manner. The payload delivery system is illustrated before or instantly after launching the payload or projectile(s) from the cartridge (FIG. 7A, time 1), early in the unfolding stage (FIG. 7B, time 2), and later in the unfolding and inversion stage (FIG. 7C, time 3). The embodiment shown in FIGS. 7A-C illustrates the vanes trailing from the aft edge of the payload cup where the pre-formed gas seal attaches to the aft end of the stabilizer and the payload cup. Seen in FIGS. 7A-C are payload cup 10, cup-shaped stabilizer 35 in its various stages of unfolding and inverting, pre-formed gas seal 110, all of which are connected by connector 60. It is emphasized that this figure is illustrative, and is not intended to disclose a "snapshot" or limit the exact spatial orientation of the unfolding stabilizer and vanes at any point in time during the flight sequence. Moreover, FIG. 7 is not intended to be limiting by illustrating the symmetric unfolding of a stabilizer.

As shown in FIGS. 7A-C having an attached pre-formed gas seal, the vanes drape over the gas seal and naturally trail from the payload cup aft edge. While not theory bound, it is believed that the stabilizer vanes may function in a similar manner as a shuttlecock during flight and add high drag and high stability to the payload delivery system as it releases its projectile or payload. In those embodiments that do not have an integral or attached pre-formed gas seal, such as when using a pre-formed gas seal that is not attached or when using wadless technology, and while not intending to be theory bound, it is envisioned that later in the flight sequence the stabilizer can trail the payload cup and contact the cup only by way of the connector 60. The high stability and high drag provided by the cup-shaped stabilizer, in turn, achieves a clean projectile or payload release from the payload cup.

While not intending to be theory bound, the cup-shaped stabilizer can be used in cartridges that launch their payloads supersonically such as shotshells, and in cartridges that might launch their payloads sub-sonically, such as chemical cartridges or possibly certain signal cartridges. When initial velocity of the payload system is supersonic, the cup-shaped stabilizer maintains its forward facing configuration until after it is launched and is in flight. Again, while not theory-bound, it is expected that once clear of the constrictions of a cartridge or launching tube, a supersonically launched payload system will open its cup-shaped stabilizer rapidly with assistance from sonic shock waves and not necessarily from drag, whereas in subsonic launching, the opening of the cup-shaped stabilizer is expected to be more draft and air resistance influenced.

When air resistance plays a role in the unfolding mechanism, partial opening of the vanes of the stabilizer exposes additional area of the stabilizer vanes to air resistance, a feature made possible by the cut and forward folded structure that initially maintained the vanes in a forward folded configuration. As unfolding progresses, the amount of exposed area of stabilizing material increases as the payload delivery system moves further downrange. Moreover, the stabilizer also begins to invert as unfolding advances, much like an umbrella is inverted by a strong gust of wind. Late in the trajectory of such a payload delivery system, it is likely that the stabilizer trails the payload cup and generally contacts the cup only by way of the point or area of connection to the payload cup, unless there is also an attached pre-formed gas seal. Therefore, this opening and reversal of direction of the stabilizer vanes imparts high stability and high drag to what it is attached, which, in turn, achieves a clean projectile or payload release from the payload cup.

Again, while not intending to be bound by theory, it is believed that the stabilizer and vanes may function in a similar manner as a shuttlecock, that is, it adds high drag and high stability to the wad structure as it releases its projectile or payload. Because the disclosed design is extremely aerodynamically stable and tends to re-orient when subjected to destabilizing forces, the stabilizer will resist the tendency to yaw and pitch that would degrade flight stability and performance of the payload as it releases from its delivery system. In the present design and like the shuttlecock, the stabilizer remains attached to the payload cup for continual stability and drag and thereby enhancing ballistic performance.

The opening of the stabilizer and/or the drag imparted by the stabilizer vanes to the payload delivery system can be regulated as desired, for example, by adjusting the longitudinal length of the vanes 90 of the stabilizer side wall 50 of the cup-shaped stabilizer and/or by the size, shape, and number of the slits, perforations, cut-outs, and the like in its side wall. While not theory bound, it is thought that the location of the stabilizer on the aft portion of the payload delivery system, that is, on the bottom (primer end or uprange end), helps impart the shuttlecock stabilizing effect. This feature contrasts with conventional one-piece plastic wads having longitudinal slits in the shot cup which form petals that peel open during flight. Stiff wads such as used in shotshells for steel shot can have petals that may open up unevenly and inconsistently, and the resulting instability can cause the opening wad to tumble, pitch, or yaw before clean separation of the wad from the shot column has been achieved.

Crimped Payload Cups

Among other things, this disclosure provides for a cylindrical payload cup having an open fore end and a closed aft end and a cup-shaped stabilizer that is nested within the payload cup. According to one aspect, the payload cup can have a closed aft end that is closed by crimping the aft end. By crimping the aft end of the payload cup closing, a structure and method of forming the closed payload cup can be attained at low cost and with minimal retooling and capital costs. Moreover, by using a simple connector such as a pop rivet, the entire crimped payload cup, cup-shaped stabilizer, and connector structure can be obtained easily and at low cost.

FIG. 8 illustrates some of the aspects and embodiments of the crimped payload cup of the present disclosure. Specifically, FIGS. 8A-D illustrate aspects of the payload delivery system prior to folding the attached stabilizer in a forward manner along the length of the payload cup, and prior to loading the system into a cartridge. FIG. 8A illustrates an end-on view, viewed perpendicular to the 500-500' line and into the open end of the payload cup of a representative embodiment of a payload delivery system 5 prior to folding the stabilizer 35 and before loading the system into a cartridge. This figure shows the payload cup 10, the stabilizer 35 prior to folding, and the connector 60, in which the aft end 20 of the payload cup is crimped closed using a 6-point star crimp 120, although this aspect is not limited to a specific type of crimp. Also illustrated is the connector 60 extends all the way through the stabilizer 35 and the crimped aft end 20 of the payload cup 35 to join these elements. In the illustrated embodiment, the connector is a "tri-grip" triangular blind rivet that accommodates the 6-point star crimp to hold the cup-shaped stabilizer to the crimped end of the payload cup very tightly. The vanes 90 of the stabilizer are illustrated in their pre-folded orientation having a size and shape that would allow them to fold forward in a manner that each vane is more-or-less flush or touching a neighboring vane.

Figure 8A:
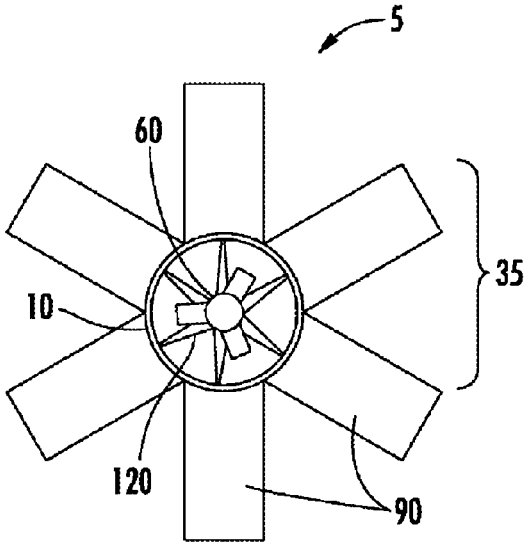
FIGS. 8A-D illustrate embodiments of the payload delivery system prior to folding the attached stabilizer in a forward manner along the length of the payload cup, and prior to loading the system into a cartridge.
Figure 8B:
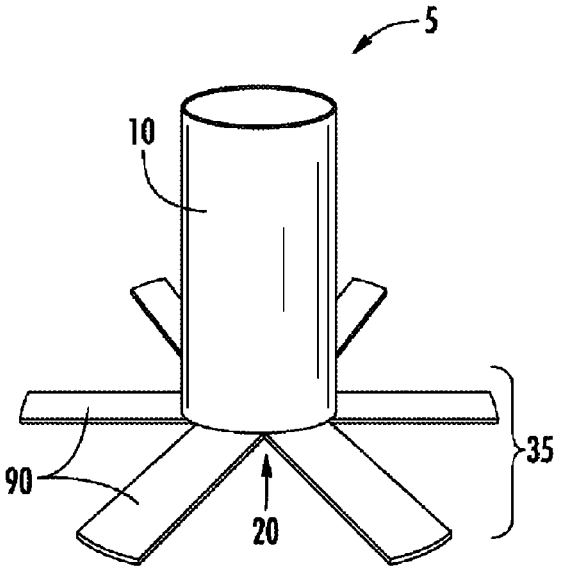

FIG. 8B illustrates a perspective view of a representative embodiment of a payload delivery system corresponding to that shown in FIG. 8A, prior to folding stabilizer vanes forward along the payload cup side wall and before loading the system into a cartridge. In this view, the connector is not seen. In both FIGS. 8A and 8B, the presence or absence of an attached pre-formed gas seal is not seen or illustrated.

Figure 8C:
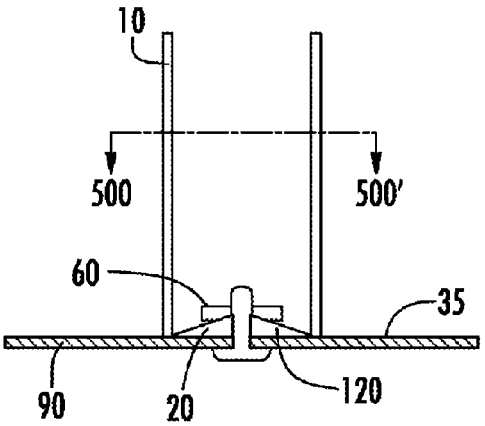

FIG. 8C illustrates a sectional view of a representative payload delivery system, showing the payload cup 10, the stabilizer 35 prior to folding the stabilizer vanes 90 and before loading the system into a cartridge, and the connector 60, in which the aft end 20 of the payload cup is crimped closed using a crimp 120. This view is prior to folding the stabilizer vanes 90 and before loading the system into a cartridge, corresponding to FIGS. 8A and 8B. In the illustrated embodiment, the connector is a blind rivet that holds the stabilizer to the crimped end of the payload cup.

Figure 8D:
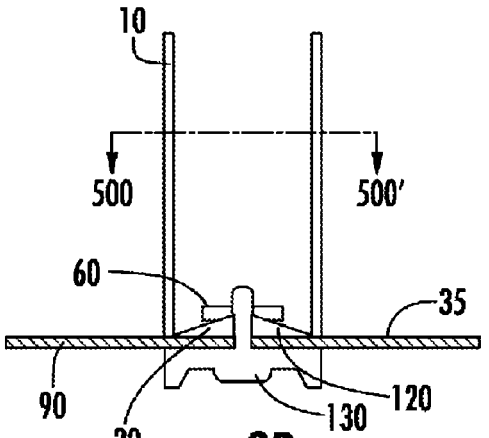

FIG. 8D illustrates a sectional view of a representative payload delivery system, also illustrating the payload cup 10, the stabilizer 35 prior to folding the stabilizer vanes 90 and before loading the system into a cartridge, and the connector 60, in which the aft end 20 of the payload cup is crimped closed using a crimp 120. This view is also prior to folding the stabilizer vanes 90 and before loading the system into a cartridge, corresponding to FIGS. 8A and 8B. The embodiment shown illustrates a "unitary" pre-formed gas seal and connector 130, also termed a "gas seal connector", which include a gas seal portion or skirt 115 and a connector portion comprising a blind rivet that is integral with the gas seal portion. The illustrated gas seal connector 130 includes a blind rivet that holds the stabilizer 35 to the crimped end of the payload cup 10, in which the pre-formed gas seal forms the head of the rivet and is an integral part thereof, thereby forming a unitary gas seal-rivet piece with both connector and gas sealing functions. This FIG. 8D arrangement can also represent those payload delivery systems in which the pre-formed gas seal is a separate component that is attached to the payload cup having a crimped aft end to the cup-shaped stabilizer with the rivet connector. Therefore, this disclosure further provides for a unitary pre-formed gas seal comprising:

a) a gas seal portion having a side wall that defines a gas-sealing skirt; and b) a connector portion integral to the gas seal portion;

wherein the gas seal portion and the connector portion are coaxially aligned and oppositely directed.

Figure 9A:
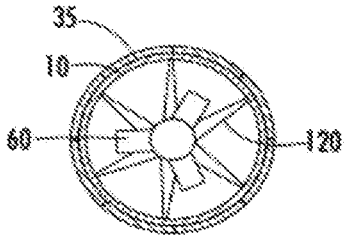
FIGS. 9A-D illustrate embodiments of the payload delivery system corresponding to FIGS. 8A-D, respectively, showing the system after folding the attached stabilizer in a forward manner along the length of the payload cup, as it would appear in a pre-launched configuration when loaded into a cartridge.

FIGS. 9A-D illustrate embodiments of the payload delivery system corresponding to FIGS. 8A-D, respectively, showing the system after forward folding the vanes 90 of the attached stabilizer 35 along the length of the payload cup 10, as it would appear in a pre-launched configuration when loaded into a cartridge. FIG. 9A provides an end-on view of the representative embodiments of a payload delivery system in its pre-launched configurations of FIGS. 9C and 9D, viewed perpendicular to the 500-500' line, and showing the payload cup 10, the forward folded stabilizer 35, and the connector 60, in which the aft end of the payload cup is crimped closed using a 6-point star crimp 120. The exemplary "tri-grip" triangular blind rivet is shown to accommodate the 6-point star crimp to hold the forward folded stabilizer to the crimped end of the payload cup very tightly.

Figure 9B:
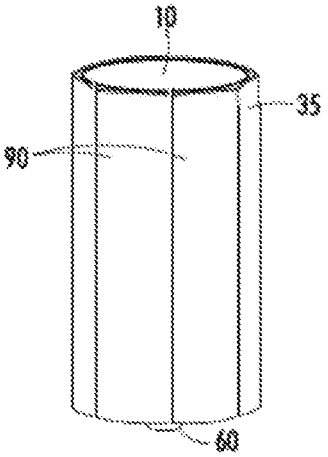

FIG. 9B illustrates a perspective view of the payload delivery system corresponding to that shown in FIG. 9A, showing the system after forward folding the vanes of the attached stabilizer 35 along the length of the payload cup 10 such that they cover the payload cup side wall, as it would appear in a pre-launched configuration when loaded into a cartridge.

Figure 9C:
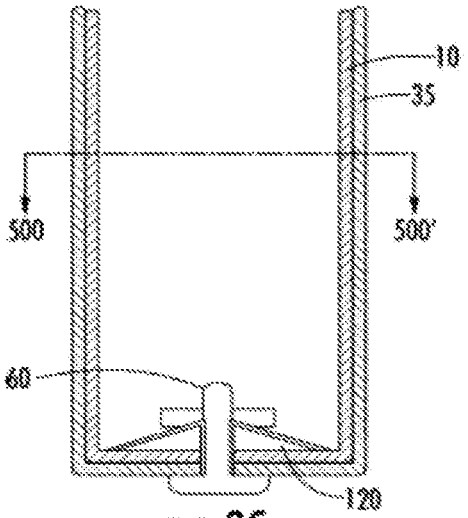
Figure 9D:
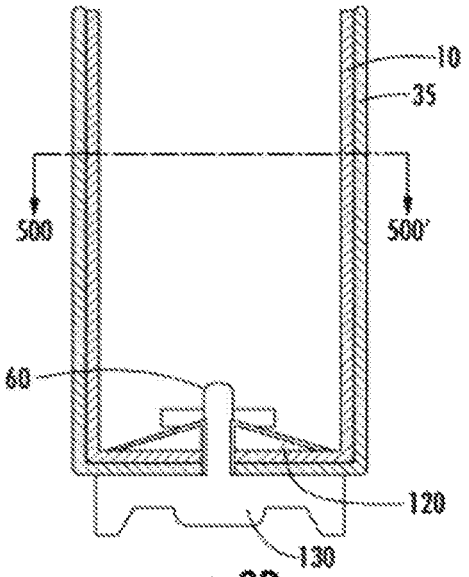

FIGS. 9C and 9D provide sectional views that correspond to FIGS. 8C and 8D, showing the payload delivery system after forward folding the vanes 90 of the attached stabilizer 35 along the length of the payload cup 10, as it would appear in a pre-launched configuration when loaded into a cartridge.

As in FIG. 8D, FIG. 9D also shows a "unitary" pre-formed "gas seal connector" 130, which combines a gas seal skirt and a connector comprising a blind rivet that is integral with the gas seal portion. The pre-formed gas seal forms the head of the rivet and accomplishes both connector and gas sealing functions. This FIG. 9D arrangement also can represent those payload delivery systems in which the pre-formed gas seal is a separate component that is attached to the payload cup having a crimped aft end to the cup-shaped stabilizer with the rivet connector.

Wadless Gas Seal Technology with the Payload Delivery System

As provided in this disclosure, the gas seal that separates the powder charge from the rest of the payload delivery system and payload can take on any number of configurations. For example, the gas seal can be a separate structure that is not attached to the payload cup and cup-shaped stabilizer combination, it can be an integral gas seal that is part of the payload cup and wad structure, or the so-called wadless technology using a granulated obturating medium can be used to seal the gases from the ejecta. Wadless materials and methods that are suitable for use with the payload delivery system of this disclosure are described in U.S. Pat. No. 7,814,820 and U.S. Patent Application Publication No. 2011/0017090 by Menefee, both of which are incorporated herein by reference in their entireties. While not intended to be limiting, wadless technology may be useful in launching powders and gels and the like relatively short distances, such as in a cartridge designed for distributing powders indoors or generally within closed confines.

As provided in the incorporated references, the wadless technology provides an extremely versatile system to launch a wide range of projectiles downrange. In this aspect, for example, the cartridge can comprise:

a) a cartridge case having a fore end and an aft end and, comprising a primer situated at the aft end;
b) a propellant adjacent the primer;
c) an obturating medium adjacent the propellant;
d) a payload delivery system adjacent the obturating medium, in which the payload delivery system comprises
   1) a payload cup having an open fore end, a closed aft end, and a cylindrical side wall defining a cavity;
   2) a cup-shaped stabilizer coaxially aligned with the payload cup, having an open fore end, a closed aft end, and a side wall comprising a plurality of vanes defined by a plurality of cuts in the side wall;
   wherein the payload cup is nested within the stabilizer, such that the payload cup aft end is adjacent and attached to the stabilizer aft end; and
   3) a connector that unites the payload cup and the cup-shaped stabilizer. and
e) a payload at least partially contained within the cavity of the payload cup;
wherein the cartridge does not contain a pre-shaped gas seal.

The obturating medium is not a pre-formed gas seal, but is usually a finely divided or granular medium such as a particulate polyolefin, which is generally contiguous with the propellant and which forms into a dense obturating mass when subjected to the pressure of firing the cartridge.

In one aspect, the material constituting the obturating medium can be in the form of particles of any shape. For manufacturing ease, the obturating medium generally can be free-flowing and non-agglomerated. A range of sizes and size distributions of particles are useful as obturating medium. According to one aspect and by way of example, a suitable obturating medium can be one that generally combines the properties of irregularly shaped particles and the small particle sizes disclosed herein. While not intending to be bound by theory, it is believed that, among other things, irregularly-shaped particles impart a high critical angle of repose to the obturating medium, which may also reflected in the ability of the particles to interlock or bridge. Also while not intending to be bound by theory, it is thought that under the extreme shear stress of the rapidly expanding combustion gases, the obturating medium behaves in a non-Newtonian fashion, conforming to parameters of the chamber throat or forcing cone and obturating the hot gases, while protecting and insulating the projectile(s).

Other features of suitable particles for the obturating medium can be found in U.S. Pat. No. 7,814,820 and U.S. Patent Application Publication No. 2011/0017090. For example, there does not appear to be a lower limit of suitable particle sizes that work. Combinations of more than one type or material or particle can be used to form the obturating medium, each of which can have the same approximate upper limit of useful particle sizes for good obturating effect. In one aspect, low density polyethylenes such as the Microthene® MN 701 series of polyethylenes from Equistar work well, either alone or in combination with other obturating media materials.

In accordance with another aspect of the wadless technology, a flow control additive can be used in conjunction with the obturating medium during loading and manufacturing, if desired. A flow control additive usually takes the form of particles that can be larger than the obturating medium particles and have antistatic or non-static properties. Typically, the volume fraction of the flow control component is less than the volume fraction of the obturating medium particles. For example, a portion of 2 parts by volume of obturating medium combined with a portion of 1 part by volume of a flow control component can be used. The smaller and the larger particles can have the same composition or can have different compositions. For example, a combination of small polyethylene or polypropylene obturating particles with larger polyethylene or polypropylene flow control particles provides a useful "combination" obturating material. In this aspect, for example, a relatively small size of low density polyethylene obturating material in combination with a larger particle size polypropylene flow control additive is useful for improved flow properties.

The composition of the obturating medium can be selected from any number of thermoplastics, thermosets, elastomers, thermoplastic elastomers, and other materials, including combinations thereof. A suitable obturating medium acts as a good seal under pressure, while also providing a thermal insulating effect which insulates and protects the projectile(s) from the intense heat of the powder combustion. This insulating effect of the obturating medium of this disclosure is provided without the obturating medium melting together to form a solid mass from the intense heat of combustion. This thermal insulating and gas-sealing effect of the obturating medium also allows a wide range or projectile types to be launched from a cartridge, and specifically permits the use of a paper or fabric cup-shaped stabilizer in the payload delivery system. The obturating medium also provides a cushion effect on the projectile(s) reducing deformation. In one aspect, suitable obturating medium compositions include, but are not limited to, various polyethylenes, polypropylenes, ethylene alpha-olefin copolymers (for example ethylene-1-hexene copolymers), propylene alpha-olefin copolymers (for example propylene-1-hexene copolymers), ethylene vinyl acetate copolymers, and the like, including any combinations or mixtures thereof, any polymer alloys thereof, or any copolymers thereof. Useful polyethylenes include high density polyethylenes, low density polyethylenes, and linear low density polyethylenes. Readily available and inexpensive low-density polyethylene, polypropylene, and combinations of polyethylene and polypropylene are suitable and relatively low cost obturating medium materials, which can provide a manufacturing advantage.

Applications to Shotshells

In one aspect, the disclosed payload delivery system is applicable to shotshell "wad" designs or muzzle-loading wad designs for firearms and other types of muzzle-loading payload launchers. Shotshell wads of various designs have been used in loading shotshell ammunition to separate the propellant from the shot, to provide a seal against hot expanding propellant gases, and more recently, to protect the barrel itself from direct contact with hard shot. Early shotshell wads were made of cardboard type materials and were used generally as over-powder wads, often in combination with fiber, cork, felt, or pressed paper filler wads. Thin card wads were also used as over shot barriers for the older roll crimped cartridges. Card wads withstood the heat of combustion very well and were simple and low cost materials. However, these early wads required rather precise internal shell dimensions for proper fit, and even then, their gas sealing properties were only moderate. Moreover, early wads offered little cushioning effect for the soft lead shot and provided no protection from direct contact with the bore;

therefore some degree of shot deformation and inconsistent patterns resulted. Improvements in gas sealing were realized with Winchester's so-called "bottle cap" cup wad introduced in the mid-1940s, which helped point the way to further advances.

Next generation wads for lead shot were plastic constructions that incorporated a flanged or slightly flared over-powder cup to provide an obturating gas seal, which was integral with a shot cup to contain and protect shot from direct barrel contact. These structures included a collapsible section interposed between the over-powder gas seal and the shot cup. Such one-piece plastic wads improved the gas sealing properties and enhanced shot integrity by the cushioning effect of the collapsible section and elimination of direct barrel contact, all of which afford improved and consistent downrange shot patterns. Longitudinal slits in the shot cup portion are typical, and these slits form petals in the cup that open up to peel away the wad from the shot column after firing. Similar plastic constructions have been adapted as sabots for single slug projectiles. While one-piece plastic wads offer certain improvements over earlier materials, their complexity and the costly tooling requirements for their manufacture can make these wads less attractive than simpler designs.

With the advent of steel and other hard shot, the barrel protection function of the wad became paramount and its shot cushioning function of less concern. As a result, steel shot wads generally dispense with any collapsible section between the gas seal and the shot cup, and steel shot wads are typically constructed of much thicker plastic to prevent shot from penetrating the shot cup itself and contacting the barrel. The thickness of the plastic wads can be problematic, often leading to high pressures upon firing and affording inconsistent opening of any petals that are pre-slit in the shot cup portion. Moreover, the consistent cutting of slits into the thick plastic walls can itself present a challenge, and their very presence may allow hard steel shot to penetrate the side wall and contact the barrel under the high pressures of firing the cartridge. The aerodynamic stability of such designs are only fair, and complete separation of the wad from the shot column may not occur before tumbling ensues and degrades its subsequent trajectory. Attempts to address these issues have required complex designs at a substantial increase in cost. In this aspect, designs with thick petals that expand from the front and/or rear, or wads with break-away portions or complex constructions have been claimed, for example, as disclosed in U.S. Pat. Nos. 4,773,329, 6,260,484, 5,979,330, and 5,874,689.

When the disclosed payload delivery system is used in loadings for shot, the stability of the system allows for clean separation of the wad structure from the shot column and provides consistent patterns and accurate delivery of the payload. While any type of shot or other projectile can be used with this payload delivery system, its performance with steel and other hard shot is an improvement over the aerodynamic stability of conventional thick plastic wads used for steel shot. Moreover, the stabilizer and vanes can be adjusted for the desired load and application, such that tight patterns can be delivered accurately at ranges that are difficult to achieve using traditional wads. For example, the length and number of the vanes of the stabilizer, the vane structure itself arising from the cut structure of the stabilizer, the inclusion of cut-outs, additional slits, perforations, and the like in the stabilizer side wall, the thickness of the stabilizer material, and the nature of the material itself, all can be adjusted to "tune" the overall payload delivery system for the desired performance.

Typically, when using steel or other hard shot, the side wall of the payload cup does not include perforations or cut-outs. Therefore, there are no problems arising from the penetration of hard shot through the payload cup and stabilizer and contacting the barrel, even though the stabilizer side wall includes cuts that define the stabilizer vanes. Moreover, when the payload delivery system includes two layers—a payload cup and a cup-shaped stabilizer—a temporary lamination effect results that provides strength to the complete payload delivery system. This lamination strength allows for relatively thin payload cups and stabilizers to be used, even for steel shot, much like the thinner shot cups traditionally suitable only for lead shot. As a result, this present system provides the necessary barrel protection function, allows a clean separation from the shot column to provide good patterns, and avoids complicated molded features that increase costs.

According to one aspect, the payload delivery system is sufficiently versatile for use in loading large or small bird shot, buck shot, slugs, or other type projectiles. Shotshell cartridges loaded with the disclosed payload delivery system can otherwise employ standard shotshell components and loading methods for their construction. By way of example, the shotshell cases or hulls, primers, propellant or powder, shot or other projectiles such as slugs, gas seals when the selected gas seal is not integral to the payload delivery system and is not a wadless obturating medium, and the like, have all been described in abundant detail. Treatises and handbooks that can be referenced for describing suitable other components include Thomas J. Griffin, editor, *Shotshell Reloading Handbook,* 5$^{th}$ ed., Lyman Publications, Lyman Products Corporation, Middletown, Conn., c. 2007 and Don Zutz, *Hodgdon Powder Company Shotshell Data Manual,* 1$^{st}$ ed., Hodgdon Power Company, Shawnee Mission, Kans., c. 1996.

Any variety of projectile types, shapes, and number can be loaded into a cartridge such as a shotshell using the disclosed payload delivery system. For example, all sizes of lead, lead-containing, lead-free, frangible, penetrating, and other projectiles can be employed, including all sizes of birdshot, buckshot, and slug projectiles. Any combination or mixture of shot sizes can be advantageously loaded using payload delivery system as provided herein. This technology is further applicable to ammunition loaded with shot comprising or consisting of steel, bismuth, tungsten, tin, iron, copper, zinc, aluminum, nickel, chromium, molybdenum, cobalt, manganese, antimony, alloys thereof, composites thereof, and any combinations thereof. These shot loadings can be standard loadings, buffered loadings, duplex loadings, loadings using any conventional configuration, whether simple or complex. For example, shot loadings can comprise at least one additional wad used with the payload delivery system according to this disclosure.

By way of example, some embodiments of the cartridge payload delivery system of this disclosure that include the forward folding stabilizer can be used to launch single solid projectiles. In these configurations, and not as a limiting feature, the solid projectile can use an optional spacer or plug, which can be in contact with and, if desired, can be attached to the aft portion of the solid projectile in its pre-launched configuration. While the spacer can be used to fill any void space for properly matching the cartridge contents to the available cartridge space, the stabilizer can function as a sabot for the solid projectile. When a forward folding stabilizer is used with a sub-bore diameter single projectile, regardless of whether a spacer is used or not, the sabot effect of the forward folding stabilizer centers the projectile within the bore, imparts cushioning properties, and boosts accuracy. This aspect of using the stabilizer itself as a solid payload cup or sabot allows tailoring the stabilizer such that it can fill all available space between the single projectile and the actual bore diameter of the launching device, such as a firearm, a concept that is carried over to using the stabilizer with a separate payload cup.

As illustrated in FIGS. 6 and 7 that show the unfolding and inversion of the cup-shaped forward folding stabilizer, after firing the solid projectile-stabilizer combination, in which the stabilizer is attached to the solid projectile with or without a spacer, the cup-shaped stabilizer unfolds and inverts to slow the payload delivery system in a controlled manner. Alternatively, when the cup-shaped stabilizer is not attached to the solid projectile, the cup-shaped stabilizer opens and slows to cleanly release the solid projectile payload. If desired, a payload cup element also can be used in combination with a solid projectile and cup-shaped stabilizer component, if so desired. Further, the projectile can include a rounded fore end while the aft end can be closed about the rear of the projectile, which optionally can be partially hollow, or the aft end of the projectile can be open. Any additional structures or features that are conventionally used in loading solid projectiles such as slugs, can be used with the forward folding stabilizing payload delivery system of this disclosure, as long as the additional structures or features do not interfere with the loading or function of the payload delivery system and stabilizer as described herein.

Other cartridge systems can advantageously use the cup-shaped stabilizer of this disclosure, including but not limited to, an ammunition cartridge, a flare cartridge; a grenade launcher cartridge, a smoke flare cartridge, a signaling device cartridge, a chemical munitions cartridge, a distraction device cartridge, or a pyrotechnic launching device cartridge. Thus, specialty cartridges using the disclosed payload delivery system also can be advantageously loaded with, for example, frangible projectiles, rubber projectiles (for example, rubber shot and rubber baton projectiles), bean bag projectiles, tear gas- or oleoresin capsicum (OC)-containing projectiles, liquid-filled marking projectiles, tracer projectiles, penetrator projectiles (for example, steel penetrator or armor-piercing projectiles), flechette projectiles, incendiary projectiles (for example, titanium sponge-containing projectiles and zirconium sponge-containing projectiles), flare projectiles, and the like, or any suitable combination thereof.

Figure 10:
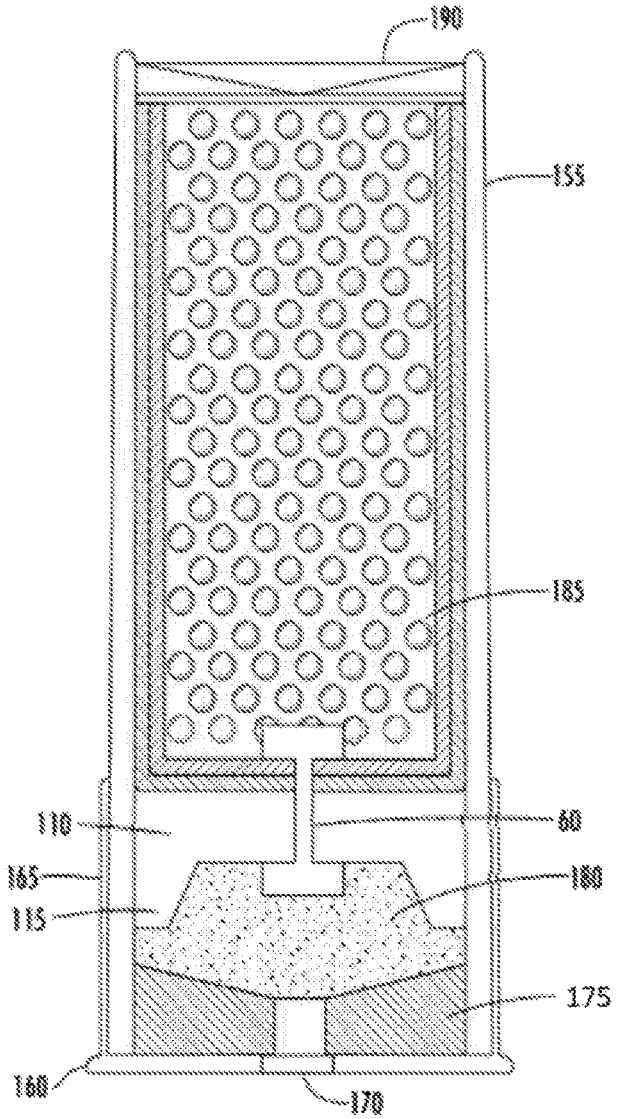
FIG. 10 illustrates a sectional view of one embodiment of a loaded shotshell using the payload delivery system according to this disclosure, in which the forward folded stabilizer is illustrated in its pre-launched and pre-inverted condition in a loaded cartridge.

FIG. 10 illustrates one embodiment of a shotshell that incorporates the payload delivery system with forward folding stabilizer according to this disclosure. This figure is intended to be non-limiting and demonstrates a simplified schematic of one way the payload delivery system of the present disclosure can be loaded and used. Full details of shotshell components such as shotshell hulls, primers, propellants, shot and the like can be found in various handbooks, such as Thomas J. Griffin, editor, *Shotshell Reloading Handbook,* 5$^{th}$ ed., Lyman Publications, Lyman Products Corporation, Middletown, Conn., c. 2007 and Don Zutz, *Hodgdon Powder Company Shotshell Data Manual,* 1$^{st}$ ed., Hodgdon Power Company, Shawnee Mission, Kans., c. 1996.

In the illustration of FIG. 10, the arrangement of the shotshell components is demonstrated which employs the payload delivery system as illustrated in FIGS. 5A or 9D in a shotshell construction. Thus, FIG. 10 illustrates, for example, the shotshell case 155 and its rim 160, the brass or head 165, the primer 170, base wad 175, and propellant 180 adjacent to the gas seal 110 with its gas-sealing skirt 115. The gas seal of FIG. 10 is a pre-formed gas seal 110 which is shown linked by connector 60 to the forward folding stabilizer 35 and the payload cup 10, and adjacent the rearward end of the stabilizer. The payload cup 10 houses the shot 185, and the shell can be crimped at the forward end with a star- or fold-crimp 190 of some type, such as a 6- or 8-point star crimp. This figure is not intended to be limiting, as any shotshell can be loaded with the payload delivery system of this disclosure, using standard procedures known to one of ordinary skill, and as described in the various treatises and handbooks such as those referenced.

In another aspect, additional cartridge components can be used with the present payload delivery system in shotshell or other cartridge loadings, as long as loading and firing the component in the cartridge does not adversely affect the utility of the disclosed payload delivery system. For example, upon firing a shotshell the column of shot pellets contained in the shot cup portion of the payload delivery system initially resists the acceleration and "set back" forces are applied by the shot in a rearward direction to the base of the wad structure. Therefore, if desired, the payload cup can include a metal or stiff paper liner to resist the deformation, or the payload cup bottom can be a thicker plastic material as compared to the sidewalls.

There are countless variations and combinations of the structures of the disclosed shotshell components, and this disclosure anticipates that any combination or feature of one component can be selected for use with any other particular feature in another component.

While not limiting, the payload delivery system of this disclosure is especially advantageous for loading shotshells with steel shot. Conventional steel plastic wads are typically much thicker and harder plastic that lead shot wads, a feature that requires larger propellant charges or longer burning propellant to make up for their poor gas sealing qualities. Such loads are inefficient in their burning of propellants and may result in greater felt recoil. More recent steel wads have relied on complex slits, petals, cut outs, flaps, and airbrakes of various shapes for stability in flight, which greatly increases the required tooling and overall manufacturing costs. Such complex and hard structures may encounter problems with certain shotgun chokes and do not always result in stable flight.

In contrast, the present payload delivery system can be used with steel shot without the need for the complex slits, cut outs, or airbrakes, because the stability and flight characteristics are influenced by the simple, inexpensive cup-shaped forward folding stabilizers disclosed here. The ease of manufacturing and lower cost makes these useful for many cartridge delivery systems, not merely for shotshells. Moreover, superior patterns can result for longer range delivery of projectiles, because the rapid and consistent opening of the forward folding stabilizer provides high drag in a symmetric fashion, which releases the payload or projectiles cleanly for excellent ballistic performance.

Vanes Formed from the Projectile Cup Itself

Figure 11A:
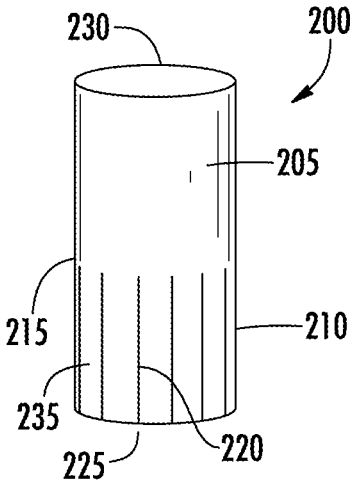
FIGS. 11A-D illustrate perspective views of a stabilized payload cup 200 before (FIG. 11A), during (FIG. 11B), and after (FIG. 11C) forward folding the integrated vanes arising from the longitudinal slits 220 in the tube 215 from which the stabilized payload cup is formed. The extend of the slits defines the payload cup portion 205 and the stabilizer portion 210 of the stabilized payload cup 200.
Figure 11B:
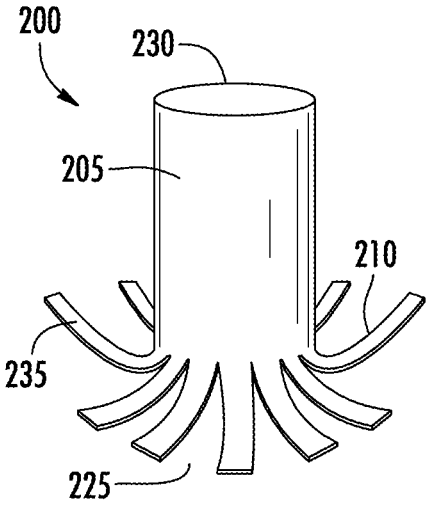
Figure 11C:
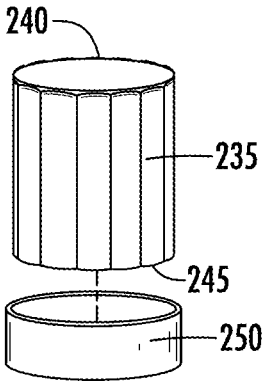
Figure 11D:
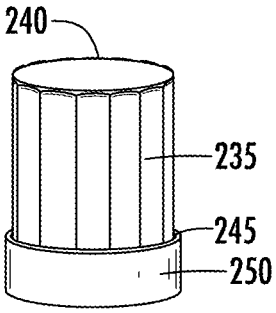
Figure 11E:
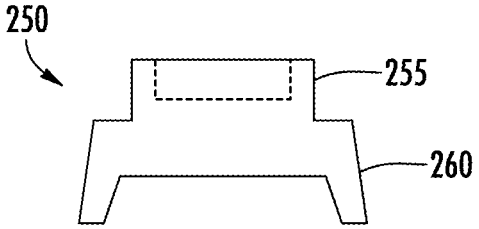
FIG. 11E illustrates a sectional view of one type of gas seal 250 which can be used in various embodiments of this disclosure, including those shown in FIGS. 11A-D. This gas seal 250 can be shaped to include a recessed forward portion 255 having a smaller diameter that the gas sealing skirt 260 situated at the aft portion of the gas seal. Some embodiments of this gas seal include a concave portion at the fore end, as illustrated in FIG. 11E.

FIGS. 11A-D illustrate perspective views of another embodiment of the payload delivery system according to this disclosure, illustrating the formation of an integrated or monolithic payload cup and stabilizer, while FIG. 11E provides a sectional view of a gas seal that is useful with the FIGS. 11A-D embodiments. This integrated or "unibody" payload cup-stabilizer 200 includes a payload cup portion 205 and a stabilizer portion 210 that are formed from the same piece. This integrated structure may be referred to as a "stabilized payload cup" 200, to emphasize its single piece construction and to distinguish it from the two or more piece constructions also disclosed herein. Because the payload cup portion 205 and the stabilizer portion 210 of the stabilized payload cup 200 are made from the same piece they have the same composition. For example, the stabilized payload cup 200 can be made from a tube 215 that is cut to length and provided with a series of slits such as the longitudinal slits 220 shown in FIG. 11A.

The tube 215 from which the stabilized payload cup is formed is open at each end, and an example of such a structure is an extruded plastic tube that can be produced very inexpensively. The slits 220 in the tube can extend from the aft end of the tube 225 for a portion or fraction of the length of the cut tube. In the embodiment shown in FIG. 11A, the longitudinal slits extend about half the distance from the aft end 225 to the forward end 230 of the tube. Accordingly, FIG. 11A shows the stabilized payload cup 200 after the tube has been cut to length and slit, but before the vanes 235 or ribbons that are formed from the longitudinal slits have been folded forward. FIG. 11B illustrates the slit tube of FIG. 11A as the vanes are being folded forward, and in FIG. 11C, the forward folding of the vanes is complete. Once folding is complete, the vanes are now aligned alongside the payload cup portion 205 of the stabilized payload cup 200. FIG. 11 illustrates the stabilized payload cup as having identical vanes, but any of the vane structures disclosed herein are suitable, because any of slits can be used.

In one aspect, once forward folding is complete, the original tube from which the stabilized payload cup 200 is made no longer has the same aft end at the original tube. Therefore, once the vanes being forward folded along the cylindrical side wall of the tube, a derivative aft end 245 and a derivative aft edge are defined. In those embodiments in which the length of the vanes is substantially the same as the length of the payload cup portion 205, the forward end of the stabilized payload cup 200 includes a contiguous payload cup portion 205 and stabilizer portions 210, and therefore can be considered to constitute or define a derivative fore end 240 and a derivative fore edge.

Also shown in FIG. 11C is a separate pre-formed gas seal, for example, a standard double-ended "H-wad" type gas seal 250, which can be used along with the stabilized payload cup 200 to both form the bottom or base of the payload cup on which the payload will sit and to provide its obturating function. Thus, the gas seal 250 has both separating and obturating functions. FIG. 11C further illustrates that the gas seal can be loaded into the cartridge adjacent the propellant, and the stabilized payload cup 200 can be loaded into the cartridge adjacent or on top of (forward) the pre-formed gas seal, followed by the payload and any subsequent components. In some embodiments, the gas seal is selected so that it can just fit inside the folded stabilized payload cup as shown in FIG. 11D. A small portion of the gas seal that does not extend completely into the folded stabilized payload cup can be seen in the embodiment of FIG. 11D, but any extent of insertion in the interior of the cup is possible. In other embodiments, it is possible that the folded stabilized payload cup 200 can be sized such that it sits atop the gas seal and the gas seal does not extend within the interior cavity of the payload cup portion 205.

In some embodiments, when the gas seal extends partially or substantially within the cavity formed by the sidewall cup of the payload cup portion 205 of the stabilized payload cup 200, it is possible to attach the gas seal 250 and the stabilized payload cup 200. For example, referring to the FIG. 11D illustration, the integral stabilized payload cup and the gas seal can be attached by a melting process, by a punching method, by a sonic weld process, by staking the stabilized payload cup 200 and the gas seal 250, and the like. In various embodiments, at least one stake can be used to attach the stabilized payload cup and the gas seal, for example, extending through the side of the stabilized payload cup, such that the stake extends into the side wall of the gas seal and unites these two components. Such embodiments provide a stable, inexpensive method to form the base of the payload cup and to provide its obturating function. Any type of connector can be used, for example, a stake, a weld, a rivet, a screw, a staple, a pin, a bolt, a brad, an anchor, an adhesive, a tack, or a nail, or in certain embodiments, multiple connectors, or any combination of these connectors can be used. When attachment means such as a stake or staple are used, the attachment means are employed so as not to also attach a forward folded vane to the side or edge of the gas seal. For example, such elements are generally used to attach the gas seal and the stabilized payload cup either before the forward folding of the vanes, or with the stake, staple, and the like being inserted between the vanes such that only the side of the stabilized payload cup and not a vane are attached to the edge of the gas seal. Some of these attachment methods, for example melting or a sonic weld process, may work best when the integral stabilized payload cup and the gas seal are made of appropriate materials.

Accordingly, this disclosure also provides for a payload delivery system comprising, in its pre-launched configuration:

a stabilized payload cup comprising a tube with an open fore end, an open aft end, and a cylindrical side wall defining a cavity that terminates at a fore edge and an aft edge;

the open aft end comprising a plurality of longitudinal slits defining a plurality of vanes extending from the aft edge along a portion of the length of the cylindrical side wall, the vanes being forward folded along the cylindrical side wall, thereby defining a derivative aft end and a derivative aft edge.

This payload delivery system can further comprising a gas seal, for example, it can further comprise a pre-formed gas seal coaxially aligned with the stabilized payload cup and adjacent the derivative aft end. Some embodiments can comprise an obturating medium adjacent the derivative aft end of the stabilizing component as the gas seal, but the preferred method and structure is to use a pre-formed gas seal with the stabilized payload cup.

One useful type of gas seal 250 which can be used in various embodiments of the stabilized payload cup 200 can be shaped to include a recessed forward portion 255, which has a smaller diameter that the gas sealing skirt 260 situated at the aft portion of the gas seal. One embodiment of such a gas seal is illustrated in the sectional view in FIG. 11E, in which this particular embodiment shows an optional concave portion at the fore end. This type of gas seal embodiment is advantageous because the recessed forward portion 255 can fit securely into the inside of the stabilized payload cup 200, while the slightly larger diameter gas sealing skirt 260 on the exterior aft end of the stabilized payload cup can perform its obturating function.

In some embodiments, the plurality of longitudinal slits can extend about 50% the length of the cylindrical side wall from the aft end to the fore end. The aft end of the stabilized payload cup also can comprise at least 3 vanes, if desired. Alternatively, the aft end of the stabilized payload cup can comprise at least 4 vanes, or alternatively, the aft end of the stabilized payload cup can comprise at least 6 vanes. Thus, these vanes invert from forward folded to rearward folded during flight. In other embodiments, a portion of the vanes can be removed from the aft edge of the stabilized payload cup. For example, the open aft end can comprise an even number of longitudinal slits defining an even number of vanes, and wherein alternating vanes are removed from the aft edge of the stabilized payload cup. Although not limited to a particular material, common materials used for the stabilized payload cup can be, can consist essentially of, or can comprise polyethylene, polypropylene, or poly(vinyl chloride).

Definitions

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

The terms "payload delivery system", "projectile delivery system", "cartridge payload delivery system" and the like are used interchangeably in this disclosure. Unless stated otherwise or unless the context requires otherwise, the use of any of these terms does not specify any particular type of projectile or payload intended to be launched from the cartridge that includes the components. Moreover, any combination of components that includes a disclosed stabilizer component can be considered to constitute a payload delivery system according to this disclosure, as the context allows or requires.

As used herein, a wad or cartridge wad according to this disclosure refers to the payload delivery system that combines a disclosed stabilizer with any type of cup, container, receptacle or holder for at least one projectile, whether shot, a slug projectile, or any type of payload to be launched by the cartridge. The term wad is often used in describing shotshell components, but by no means is the use of this term or this entire disclosure so limited. To the contrary, it is understood that this disclosure and the appended claims are not limited to shotshells, because the disclosed structures, components, and methods have a wide utility and are adaptable to any number of payload delivery systems, for example, those applicable to launching chemical, pyrotechnic, signaling, non-lethal, and other complex payloads in their respective cartridges.

As the context allows, the term "cartridge" can refer to the finished manufactured article, such as a completed ammunition cartridge. However, in some contexts, the term "cartridge" may refer to the empty cartridge "case", "hull", or "casing", having an inner wall defining a cavity that is charged according to this disclosure to provide the finished article, as apparent from its particular use.

Reference to the forward end or fore end of a particular component or cartridge means the end that is further downrange when the component or cartridge is in its intended orientation for firing or launching. The fore end may also be termed the leading end or leading edge, the top, the downrange end, the distal end, or the crimp end, and these terms are used interchangeably.

Reference to the rearward or rear end of a particular component or cartridge means the end that is further uprange when the component or cartridge is in its intended orientation for firing or launching. The rear end may also be termed trailing end or trailing edge, the aft portion or aft end, the bottom, the uprange end, the proximal end, the primer end, or the brass end, and these terms are used interchangeably.

A cup-shaped stabilizer, forward folding stabilizer, forward folded stabilizer, stabilizer cup, stabilizer with cut side wall, or simply, "stabilizer" and similar terms are used in this disclosure to refer to the element of the payload delivery system that contains a disclosed structure with vanes. Such terms generally are used interchangeably regardless of whether that component is used with or without a payload cup, and regardless of whether that component is attached to any projectile or any other component.

Reference to an obturating component or obturating member can include any component, whether pre-formed or not, that can provide a seal against expanding propellant gases, and can comprise, can consist of, or can be a pre-formed gas seal or an obturating medium. Unless the context requires otherwise or unless otherwise provided, the term gas seal also can refer to either a pre-formed gas seal or an obturating medium. Moreover, when describing a gas seal as a pre-formed gas seal, such a reference includes a separate component and a component integrated into a more complex payload delivery system or combined with another component, as the context requires.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not. Therefore, this disclosure both literally includes and literally excludes such components as desired or required.

Unless indicated otherwise, when a range of any type is disclosed or claimed, for example a range of the particle sizes, percentages, temperatures, and the like, it is intended to disclose or claim individually each possible number that such a range could reasonably encompass, including any sub-ranges or combinations of sub-ranges encompassed therein. When describing a range of measurements such as sizes or weight percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of percentages such as from 85% to 95%, it is understood that this disclosure is intended to encompass each of 85%, 86%, 87%, 88%, 89%, 90%, 91%, 92%, 93%, 94%, and 95%, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A payload delivery system comprising, in its pre-launched configuration:

a stabilized payload cup formed of a tube having a payload cup section with an outer surface and a contiguous stabilizer section, the stabilizer section having an edge and a plurality of longitudinal slits defining a plurality of vanes extending rearward from the payload cup section to the edge of the stabilizer section, in which the vanes of the stabilizer section are forward folded along a least a portion of the outer surface of the payload cup section, thereby defining an open fore end, an open aft end, and a cylindrical side wall, the cylindrical side wall defining a cavity that terminates at a fore edge and an aft edge;

wherein the forward folded vanes of the stabilizer section extend from the aft edge along at least a portion of the length of the cylindrical side wall.

2. A payload delivery system according to claim 1, further comprising a pre-formed gas seal coaxially aligned with the stabilized payload cup and adjacent the aft end.

3. A payload delivery system according to claim 1, further comprising a pre-formed gas seal coaxially aligned with the stabilized payload cup and adjacent the aft end, wherein the pre-formed gas seal is situated at least partially within the cavity defined by the cylindrical side wall, or the pre-formed gas seal is attached to the stabilized payload cup.

4. A payload delivery system according to claim 1, further comprising a gas seal comprising an obturating medium adjacent the aft end.

5. A payload delivery system according to claim 1, wherein the plurality of forward folded vanes extend less than or equal to the length of the cylindrical side wall from the aft end to the edge of the stabilizer section.

6. A payload delivery system according to claim 1, wherein the plurality of forward folded vanes extend greater than the length of the cylindrical side wall from the aft end to the edge of the stabilizer section.

7. A payload delivery system according to claim 1, wherein the stabilizer section comprises at least 3 vanes.

8. A payload delivery system according to claim 1, wherein the plurality of vanes of the stabilizer section invert from forward folded to rearward folded during flight of the stabilized payload cup.

9. A payload delivery system according to claim 1, wherein a portion of the vanes are removed from the aft edge of the stabilized payload cup.

10. A payload delivery system according to claim 1, wherein the stabilized payload cup comprises paper, polymer, polymer coated paper, composite, laminate, or textile.

11. A payload delivery system according to claim 1, wherein the stabilized payload cup comprises polyethylene, polypropylene, or poly(vinyl chloride).

12. A cartridge comprising a payload delivery system according to claim 1.

13. A cartridge comprising:

a) a cartridge case having a fore end and an aft end, and comprising a primer situated at the aft end;

b) a propellant adjacent the primer;

c) an obturating component adjacent the propellant;

d) a payload delivery system according to claim 1 adjacent the obturating component, and e) a payload at least partially contained within the cavity of the stabilized payload cup of the payload delivery system.

14. A cartridge according to claim 13, wherein the obturating component comprises a pre-formed gas seal or an obturating medium.

15. A cartridge according to claim 13, wherein the payload comprises at least one projectile, the projectile comprising steel, bismuth, tungsten, tin, iron, copper, zinc, aluminum, nickel, chromium, molybdenum, cobalt, manganese, antimony, alloys thereof, composites thereof, or any combinations thereof.

16. A cartridge according to claim 13, wherein the payload comprises at least one projectile selected from birdshot, buckshot, or slug projectiles.

17. A cartridge according to claim 13, wherein the cartridge is an ammunition cartridge, a flare cartridge, a smoke flare cartridge, a signaling device cartridge, a chemical cartridge, a distraction device cartridge, a pyrotechnic launching device cartridge, a marking cartridge, a grenade launcher cartridge, an incendiary cartridge, an explosive cartridge, a tracer cartridge, an armor-piercing cartridge, or a non-lethal cartridge.

18. A cartridge according to claim 13, wherein the payload comprises a frangible projectile, a non-frangible projectile, a lead projectile, a non-lead metal projectile, a steel projectile, a rubber projectile, a bean bag projectile, a tear gas-containing projectile, an oleoresin capsicum-containing projectile, a liquid-containing projectile, a powder-containing projectile, a gel-containing projectile, a marking projectile, a tracer projectile, a penetrator projectile, a flechette projectile, an armor-piercing projectile, an explosive projectile, an incendiary projectile, a flare projectile, or any combination thereof.

19. A cartridge according to claim 13, wherein the plurality of vanes of the stabilizer section invert from forward folded to rearward folded during flight of the stabilized payload cup.

20. A payload delivery system according to claim 13, wherein the stabilized payload cup comprises paper, polymer, polymer coated paper, composite, laminate, or textile.

* * * * *